US012320090B2

(12) United States Patent
White et al.

(10) Patent No.: US 12,320,090 B2
(45) **Date of Patent: *Jun. 3, 2025**

(54) METHODS AND APPARATUSES FOR COMPACTING SOIL AND GRANULAR MATERIALS

(71) Applicant: Geopier Foundation Company, Inc., Davidson, NC (US)

(72) Inventors: David J. White, Davidson, NC (US); Kord J. Wissmann, Davidson, NC (US)

(73) Assignee: Geopier Foundation Company, Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/376,201

(22) Filed: Oct. 3, 2023

(65) Prior Publication Data

US 2024/0026625 A1 Jan. 25, 2024

Related U.S. Application Data

(60) Division of application No. 17/171,664, filed on Feb. 9, 2021, now Pat. No. 11,773,555, which is a continuation-in-part of application No. 16/450,405, filed on Jun. 24, 2019, now Pat. No. 10,941,534, which is a division of application No. 15/645,322, filed on Jul. 10, 2017, now Pat. No. 10,329,728, which is a continuation of application No. 14/916,741, filed as application No. PCT/US2014/054374 on Sep. 15, 2014, now Pat. No. 9,702,107.

(60) Provisional application No. 61/873,993, filed on Sep. 5, 2013.

(51) Int. Cl.

| | |
|---|---|
| ***E02D 3/046*** | (2006.01) |
| ***E01C 21/00*** | (2006.01) |
| ***E02D 3/08*** | (2006.01) |

(52) U.S. Cl.

CPC ..... *E02D 3/046* (2013.01); *E01C 21/00* (2013.01); *E02D 3/08* (2013.01)

(58) Field of Classification Search

CPC ..... E01C 21/00; E02D 3/046; E02D 3/08
USPC ..... 404/75; 405/237
See application file for complete search history.

(56) References Cited

U.S. PATENT DOCUMENTS

| | | | | |
|---|---|---|---|---|
| 1,706,002 | A | 3/1929 | Sipe | |
| 1,904,079 | A | 4/1933 | Powell | |
| 1,931,845 | A | 10/1933 | Hart et al. | |
| 1,951,643 | A * | 3/1934 | Bald | E02D 5/44 405/233 |

(Continued)

OTHER PUBLICATIONS

International Search Report and Written Opinion issued in counterpart PCT Application No. PCT/US2014/054374 dated Dec. 22, 2014.

*Primary Examiner* — Raymond W Addie
(74) *Attorney, Agent, or Firm* — E. Eric Mills; Todd A. Serbin; Maynard Nexsen PC

(57) ABSTRACT

An apparatus for densifying and compacting granular materials comprising a drive shaft having a first diameter and a compaction end, and a set of one or more diametric expansion elements attached to an exterior of the compaction end of the drive shaft, wherein the one or more diametric expansion elements, in their expanded state, form compaction surfaces having a second diameter greater than the first diameter of the drive shaft.

10 Claims, 18 Drawing Sheets

(56) References Cited

U.S. PATENT DOCUMENTS

| | | | |
|---|---|---|---|
| 4,644,715 | A | 2/1987 | Burell et al. |
| 5,100,262 | A | 3/1992 | Michael et al. |
| 5,122,013 | A | 6/1992 | Junsheng et al. |
| 5,249,892 | A | 10/1993 | Fox |
| 6,672,408 | B2 | 1/2004 | Frantz |
| 7,604,437 | B2 | 10/2009 | Wissmann |
| 7,621,098 | B2 * | 11/2009 | Reinert, Sr. ..... E02D 5/803 52/742.1 |
| 8,152,415 | B2 | 4/2012 | Fox |
| 2002/0009337 | A1 | 1/2002 | Fox |
| 2004/0115011 | A1 | 6/2004 | Fox |
| 2007/0077128 | A1 | 4/2007 | Wissmann |
| 2008/0205993 | A1 | 8/2008 | Wissmann et al. |
| 2010/0028087 | A1 | 2/2010 | Wissmann |
| 2011/0052330 | A1 | 3/2011 | Wissmann et al. |
| 2016/0208452 | A1 | 7/2016 | Verdin et al. |
| 2019/0309494 | A1 | 10/2019 | White et al. |
| 2021/0164185 | A1 | 6/2021 | White et al. |

* cited by examiner

1000

1100

METHODS AND APPARATUSES FOR COMPACTING SOIL AND GRANULAR MATERIALS

CROSS-REFERENCE TO RELATED APPLICATIONS

The presently disclosed subject matter is a divisional application of and claims priority to U.S. patent application Ser. No. 17/171,664 filed Feb. 9, 2021, which is a continuation-in-part of and claims priority to U.S. patent application Ser. No. 16/450,405 filed Jun. 24, 2019 (now U.S. Pat. No. 10,941,534 issued Mar. 9, 2021), which is a divisional of and claims priority to U.S. patent application Ser. No. 15/645,322 filed on Jul. 10, 2017 (now U.S. Pat. No. 10,329,728 issued Jun. 25, 2019), which is a continuation of and claims priority to U.S. patent application Ser. No. 14/916,741 filed on Mar. 4, 2016 (now U.S. Pat. No. 9,702,107 issued Jul. 11, 2017), which is a U.S. national phase application of International Patent Application No. PCT/US2014/054374 filed on Sep. 5, 2014, which is related to and claims priority to U.S. Provisional Patent Application No. 61/873,993 filed on Sep. 5, 2013; the entire disclosures of which are incorporated herein by reference.

TECHNICAL FIELD

The presently disclosed subject matter relates generally to the compaction and densification of granular subsurface materials and more particularly to methods and apparatuses for compacting soil and granular materials that are either naturally deposited or consist of man-placed fill materials for the subsequent support of structures, such as buildings, foundations, floor slabs, walls, embankments, pavements, and other improvements.

BACKGROUND

Heavy or settlement sensitive facilities that are located in areas containing soft, loose, or weak soils are often supported on deep foundations. Such deep foundations are typically made from driven pilings or concrete piers installed after drilling. The deep foundations are designed to transfer structural loads through the soft soils to more competent soil strata. Deep foundations are often relatively expensive when compared to other construction methods.

Another way to support such structures is to excavate out the soft, loose, or weak soils and then fill the excavation with more competent material. The entire area under the building foundation is normally excavated and replaced to the depth of the soft, loose, or weak soil. This method is advantageous because it is performed with conventional earthwork methods, but has the disadvantages of being costly when performed in urban areas and may require that costly dewatering or shoring be performed to stabilize the excavation.

Yet another way to support such structures is to treat the soil with "deep dynamic compaction" consisting of dropping a heavy weight on the ground surface. The weight is dropped from a sufficient height to cause a large compression wave to develop in the soil. The compression wave compacts the soil, provided the soil is of a sufficient gradation to be treatable. A variety of weight shapes are available to achieve compaction by this method, such as those described in U.S. Pat. No. 6,505,998. While deep dynamic compaction may be economical for certain sites, it has the disadvantage that it induces large waves as a result of the weight hitting the ground. These waves may be damaging to structures. The technique is deficient because it is only applicable to a small band of soil gradations (particle sizes) and is not suitable for materials with appreciable fine-sized particles.

In recent years, aggregate columns have been increasingly used to support structures located in areas containing soft soils. The columns are designed to reinforce and strengthen the soft layer and minimize resulting settlements. The columns are constructed using a variety of methods including the drilling and tamping method described in U.S. Pat. Nos. 5,249,892 and 6,354,766; the tamper head driven mandrel method described in U.S. Pat. No. 7,226,246; the tamper head driven mandrel with restrictor elements method described in U.S. Pat. No. 7,604,437; and the driven tapered mandrel method described in U.S. Pat. No. 7,326,004; the entire disclosures of which are incorporated by reference in their entirety.

The short aggregate column method (U.S. Pat. Nos. 5,249,892 and 6,354,766), which includes drilling or excavating a cavity, is an effective foundation solution when installed in cohesive soils where the sidewall stability of the hole is easily maintained. The method generally consists of: a) drilling a generally cylindrical cavity or hole in the foundation soil (typically around 30 inches); b) compacting the soil at the bottom of the cavity; c) installing a relatively thin lift of aggregate into the cavity (typically around 12-18 inches); d) tamping the aggregate lift with a specially designed beveled tamper head; and e) repeating the process to form an aggregate column generally extending to the ground surface. Fundamental to the process is the application of sufficient energy to the beveled tamper head such that the process builds up lateral stresses within the matrix soil up along the sides of the cavity during the sequential tamping. This lateral stress build up is important because it decreases the compressibility of the matrix soils and allows applied loads to be efficiently transferred to the matrix soils during column loading.

The tamper head driven mandrel method (U.S. Pat. No. 7,226,246) is a displacement form of the short aggregate column method. This method generally consists of driving a hollow pipe (mandrel) into the ground without the need for drilling. The pipe is fitted with a tamper head at the bottom which has a greater diameter than the pipe and which has a flat bottom and beveled sides. The mandrel is driven to the design bottom of column elevation, filled with aggregate and then lifted, allowing the aggregate to flow out of the pipe and into the cavity created by withdrawing the mandrel. The tamper head is then driven back down into the aggregate to compact the aggregate. The flat bottom shape of the tamper head compacts the aggregate; the beveled sides force the aggregate into the sidewalls of the hole thereby increasing the lateral stresses in the surrounding ground. The tamper head driven mandrel with restrictor elements method (U.S. Pat. No. 7,604,437) uses a plurality of restrictor elements installed within the tamper head 112 to restrict the backflow of aggregate into the tamper head during compaction.

The driven tapered mandrel method (U.S. Pat. No. 7,326,004) is another means of creating an aggregate column with a displacement mandrel. In this case, the shape of the mandrel is a truncated cone, larger at the top than at the bottom, with a taper angle of about 1 to about 5 degrees from vertical. The mandrel is driven into the ground, causing the matrix soil to displace downwardly and laterally during driving. After reaching the design bottom of the column elevation, the mandrel is withdrawn, leaving a cone shaped cavity in the ground. The conical shape of the mandrel allows for temporarily stabilizing of the sidewalls of the hole such that aggregate may be introduced into the cavity from the ground surface. After placing a lift of aggregate, the mandrel is re-driven downward into the aggregate to compact the aggregate and force it sideways into the sidewalls of the hole. Sometimes, a larger mandrel is used to compact the aggregate near the top of the column.

SUMMARY

The present disclosure relates generally to an apparatus for densifying and compacting granular materials. In some embodiments, the apparatus may include a closed end drive shaft and one or more diametric expansion elements. The diametric expansion elements, in their expanded state, may form compaction surfaces having a diameter greater that the diameter of the drive shaft. The diametric expansion elements may be attached to a bottom surface of the drive shaft, or attached to a base plate attached to the bottom end of the drive shaft. The base plate may be changeable.

The diametric expansion elements may include any one or more of chains, cables, wire rope, and/or a lattice of vertically and/or horizontally connected chains, cables, or wire rope. The diametric expansion elements may be configured and sized accordingly to achieve desired lift thickness, compaction surface area, and/or soil flow based on material type and/or project requirements. Additionally, the diametric expansion elements may be housed within a sacrificial tip that may be releasably connected to a bottom portion of the drive shaft. The apparatus may also include one or more wing structures attached to the drive shaft that are configured to loosen free-field soils around the drive shaft.

In certain other embodiments, the apparatus may include a drive shaft, a compaction chamber at a lower end of the drive shaft, and one or more diametric expansion elements, wherein the apparatus further includes an opening in an upper surface of the compaction chamber forming a flow-through passage exterior of the drive shaft and configured for accepting granular materials from outside of the drive shaft. The drive shaft may be the same size and/or diameter, a larger size and/or diameter, or a smaller size and/or diameter than the compaction chamber. Additionally, the compaction chamber may be connected to the drive shaft through a load transfer plate, and may further incorporate one or more stiffener plates connected to the drive shaft and the load transfer plate.

Certain embodiments of the apparatus may include one or more diametric expansion and restriction elements attached to one or both of an interior or exterior of the compaction chamber. The one or more diametric expansion and restriction elements may also be attached to the load transfer plate. The apparatus may include both interior diametric restriction elements and exterior diametric expansion elements. Moreover, the interior diametric restriction elements and exterior diametric expansion elements may or may not be connected to one another. The drive shaft may include a hollow tube, a substantially I-beam configuration that may further include an opening in the I-beam configuration, or a solid cylindrical shaft configuration. The apparatus may further be configured to be inserted in a pre-drilled cavity.

In certain other aspects of the present disclosure, an apparatus for densifying and compacting granular materials is presented according to other embodiments. The apparatus may include a drive shaft, a compaction chamber, and one or more diametric restriction elements, wherein the compaction chamber comprises a pipe and the drive shaft is fitted into one end of the pipe. The apparatus may be configured to be inserted in a pre-drilled cavity. In some embodiments, the drive shaft includes an I-Beam configuration, and may further include an opening in the I-Beam configuration wherein at least a portion of the opening in the drive shaft may extend into the pipe. Certain embodiments may also include a reinforcing ring fitted around a bottom end of the compaction chamber, and may further include a substantially ring-shaped wearing pad abutting the reinforcement ring.

Embodiments of the apparatus may also include a ring that may be secured to the compaction chamber and positioned near the end of the drive shaft that includes an arrangement of the diametric restriction elements. A second arrangement of diametric restriction elements may be secured to the drive shaft. The ring may be optionally removable.

In certain other embodiments, the apparatus may include a drive pipe affixed to a lower end of the drive shaft, wherein a bottom end of the drive pipe may extend into the compaction chamber, and further wherein the drive pipe may secured to the compaction chamber by one or more struts or plates extending from sides of the compaction chamber radially inward to the drive pipe. The one or more struts or plates may extend along the drive pipe above the compaction chamber to a termination point, tapering from the sides of the compaction chamber to the termination point. Additionally, a bottom end of the drive pipe may be closed using a plate or cap and the plate or cap extends below a lower end of the one or more struts or plates.

Other embodiments of the apparatus may also include a perimeter ring inside the compaction chamber, the ring including an arrangement of the diametric restriction elements and being disposed along the inner perimeter of the compaction chamber at substantially the lower end of the one or more struts or plates. The ring may be removable. The apparatus may also include diametric restriction elements that are coupled to the lower end of the one or more struts or plates and the perimeter of the plate or cap.

In still other embodiments, an air injection line extending along the drive shaft with at least one discharge port along the mandrel may be used to provide positive air pressure required for increasing interior and/or exterior aggregate flow during installations. The discharge port may be located, for example, along the drive shaft at a location above the compaction chamber. Certain other embodiments may include multiple air injection lines with one or more discharge ports along the drive shaft. In such embodiments, the discharge ports may be oriented such that the air pressure is directed outwards towards the soil cavity to facilitate exterior aggregate flow, inwards towards the drive shaft or downwards along the drive shaft to facilitate interior aggregate flow, or a combination thereof.

Certain other aspects of the present disclosure include a method of densifying and compacting granular materials, the method including the steps of (a) providing a compaction apparatus comprising a closed end drive shaft having a first diameter and one or more diametric expansion elements, wherein the one or more diametric expansion elements expand when the apparatus is driven downward forming compaction surfaces having a second diameter greater than the first diameter of the drive shaft, (b) driving the compaction apparatus into free-field soils to a specified depth, (c) lifting the compaction apparatus a specified distance, and (d) repeating the driving and lifting of the compaction apparatus. The method may also include repeating the driving and lifting steps incrementally until the compaction apparatus has been lifted to or near an original ground elevation. In such embodiments, each of the repeated driving of the compaction apparatus may be to a distance generally less than a distance the compaction apparatus was previously lifted.

Driving of the compaction apparatus may be effectuated using one of an impact or vibratory hammer. In certain embodiments, the lifting of the compaction apparatus allows for surrounding materials to flow around the compaction apparatus to fill a void created by lifting the compaction apparatus. In some embodiments, the one or more diametric expansion elements may be placed within a sacrificial tip and upon the initial lifting of the compaction apparatus the one or more diametric expansion elements are removed from the sacrificial tip and move downward relative to the compaction apparatus so as to hang from a bottom portion of the compaction apparatus. The method may, in some embodiments, create a well compacted column of densified soil below and around the one or more diametric expansion elements.

Certain other embodiments of methods of densifying and compacting granular materials include the steps of (a) providing a compaction apparatus comprising a drive shaft, a compaction chamber at a lower end of the drive shaft, and one or more diametric expansion elements, wherein the apparatus further comprises an opening in an upper surface of the compaction chamber comprising a flow-through passage exterior of the drive shaft and configured for accepting granular materials from outside of the drive shaft, (b) driving the compaction apparatus into free-field soils to a specified depth, (c) lifting the compaction apparatus a specified distance such that the one or more diametric restriction elements move downward relative to the compaction apparatus to hang from connections to the compaction apparatus thereby allowing granular materials located above a top portion of the compaction chamber to flow through the flow-through passage, (d) re-driving the apparatus downwardly into the free-field soils causing the one or more diametric restriction elements to bunch-up forming compaction surfaces, and (e) repeating the driving and lifting of the compaction apparatus. Moreover, other methods of densifying and compacting granular materials may include the steps of (a) providing a compaction apparatus comprising a drive shaft, a compaction chamber, and one or more diametric restriction elements, wherein the compaction chamber comprises a pipe and the drive shaft is fitted into one end of the pipe, (b) driving the compaction apparatus into free-field soils to a specified depth, (c) lifting the compaction apparatus a specified distance such that the one or more diametric restriction elements move downward relative to the compaction apparatus to hang from connections to the compaction apparatus thereby allowing granular materials located above a top portion of the compaction chamber to flow around the outside of the drive shaft and into the compaction chamber, (c) re-driving the apparatus downwardly into the free-field soils causing the one or more diametric restriction elements to bunch-up forming compaction surfaces; and (d) repeating the driving and lifting of the compaction apparatus.

BRIEF DESCRIPTION OF THE DRAWINGS

Figure 1A:
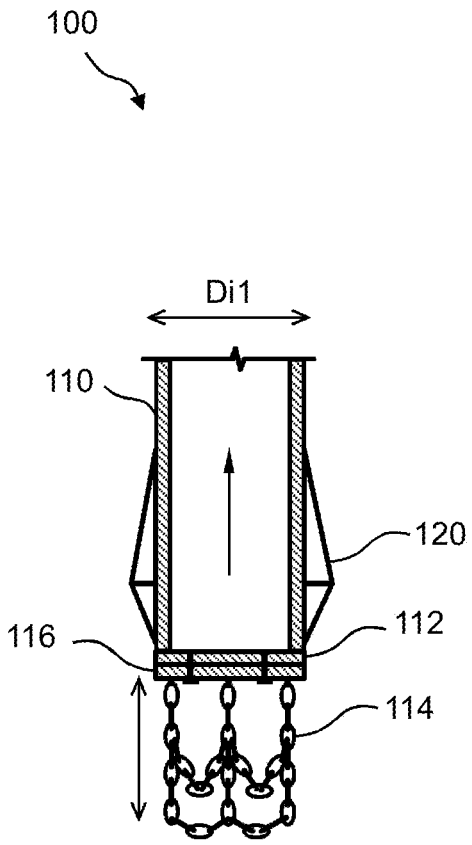
Figure 1B:
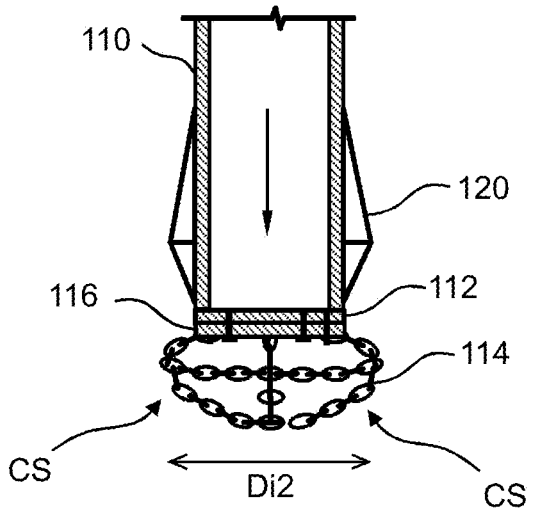
Figure 2:
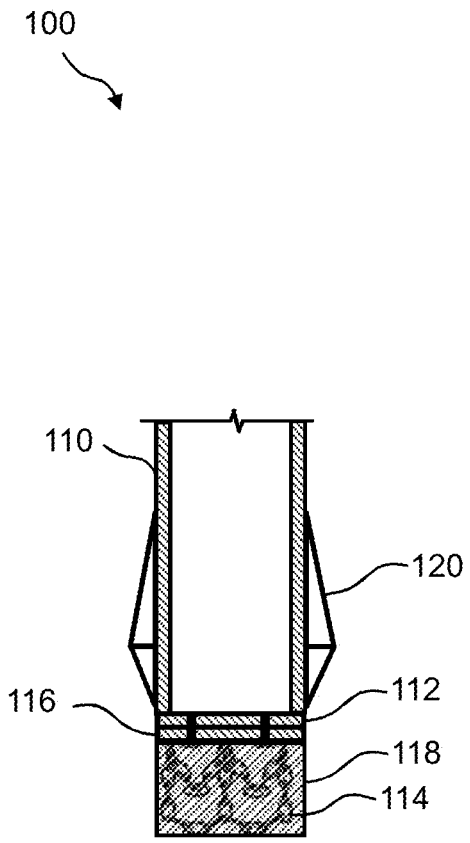
Figure 3A:
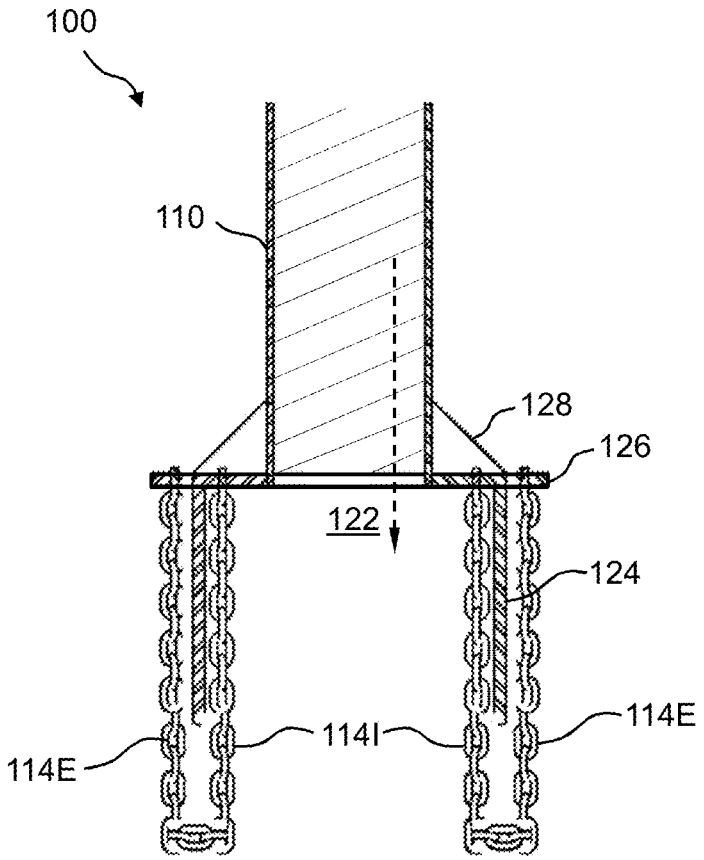
Figure 3B:
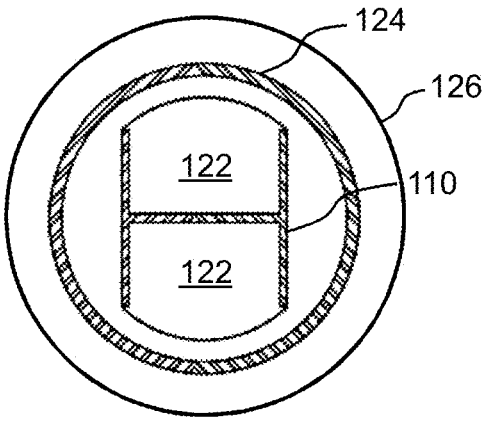
Figure 4A:
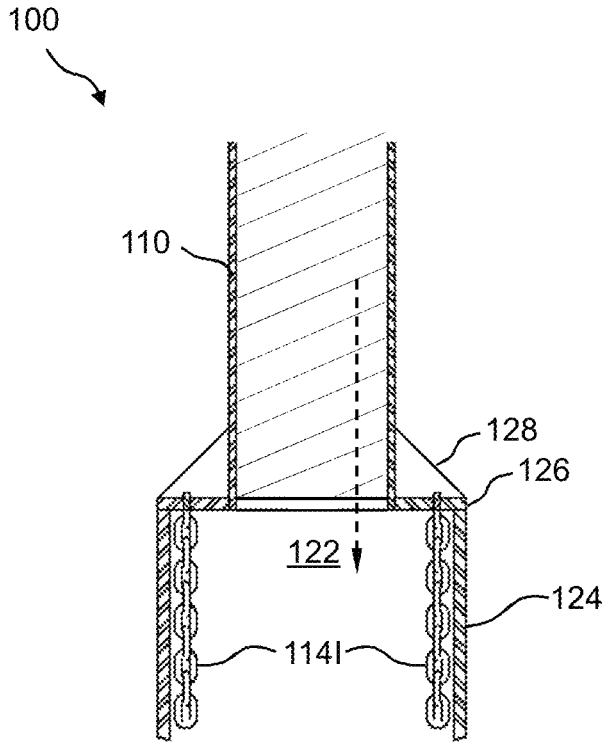
Figure 4B:
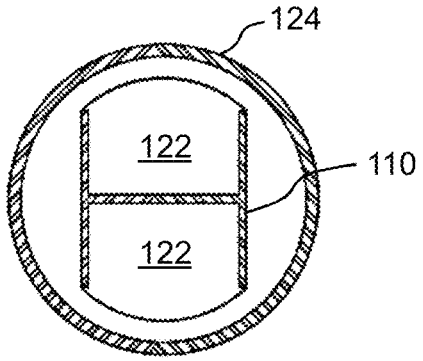
Figure 5:
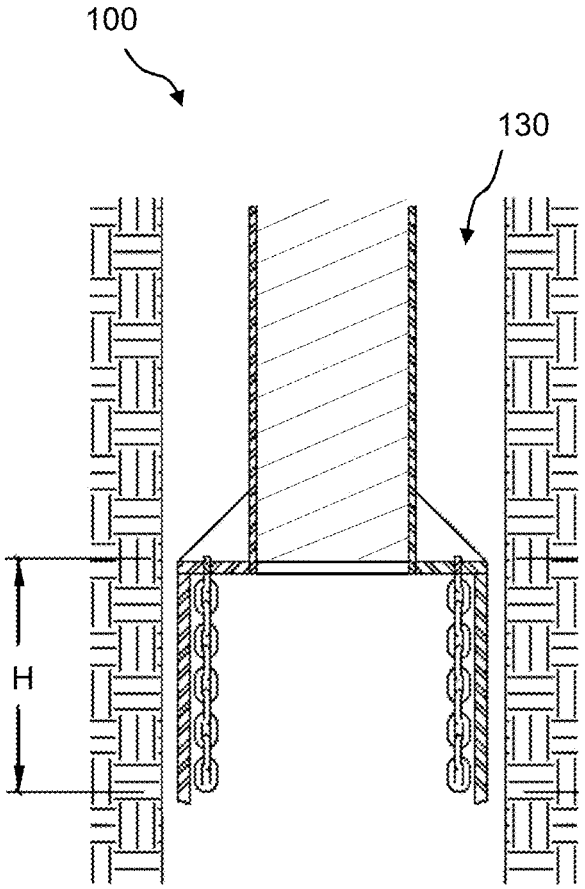
Figure 6:
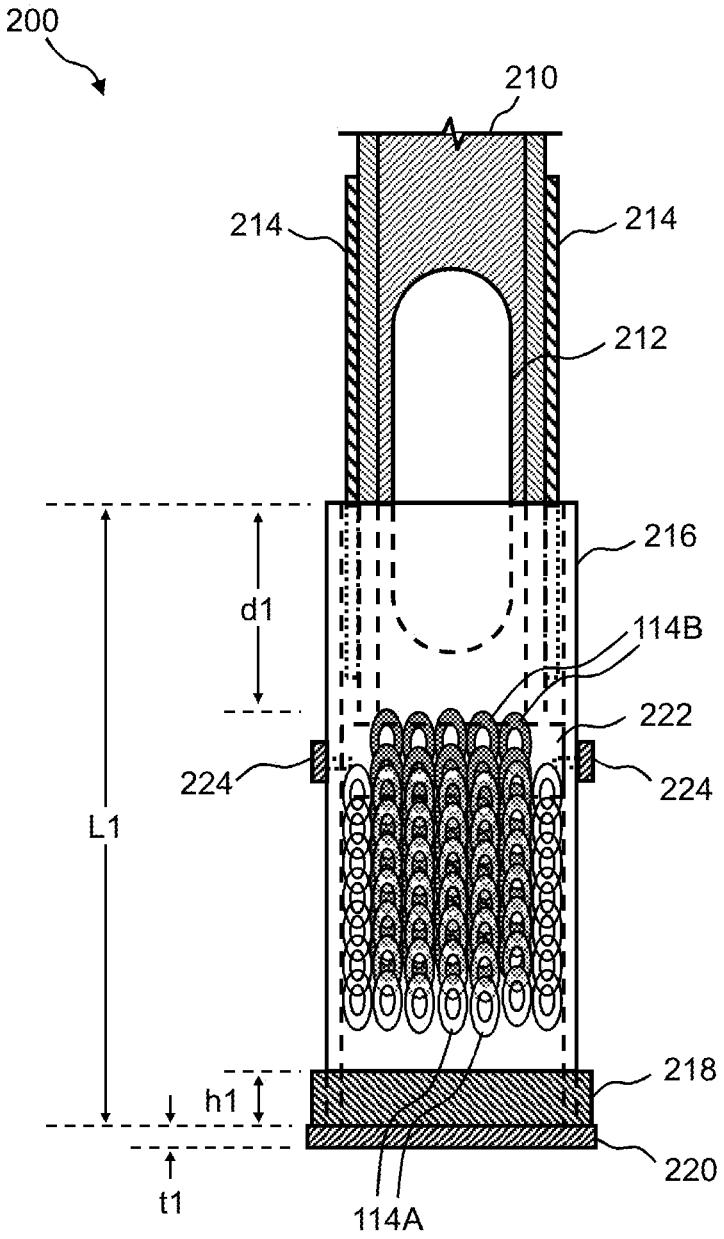
Figure 7A:
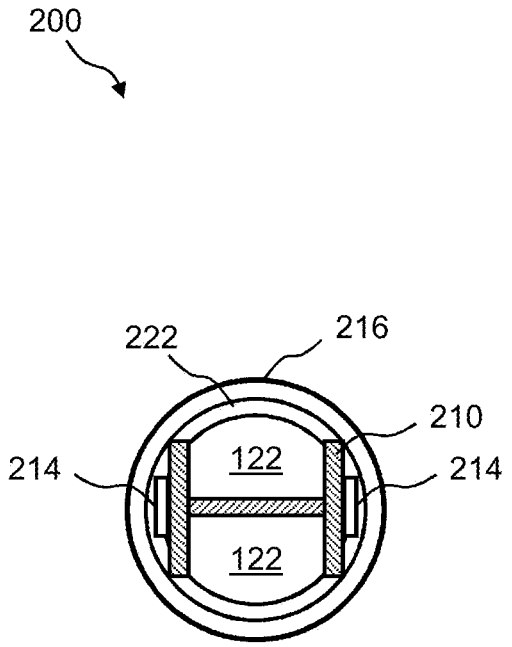
Figure 7B:
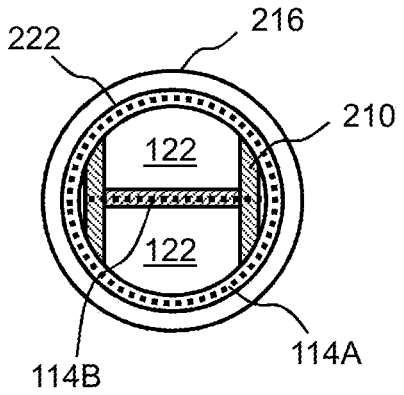
Figure 8A:
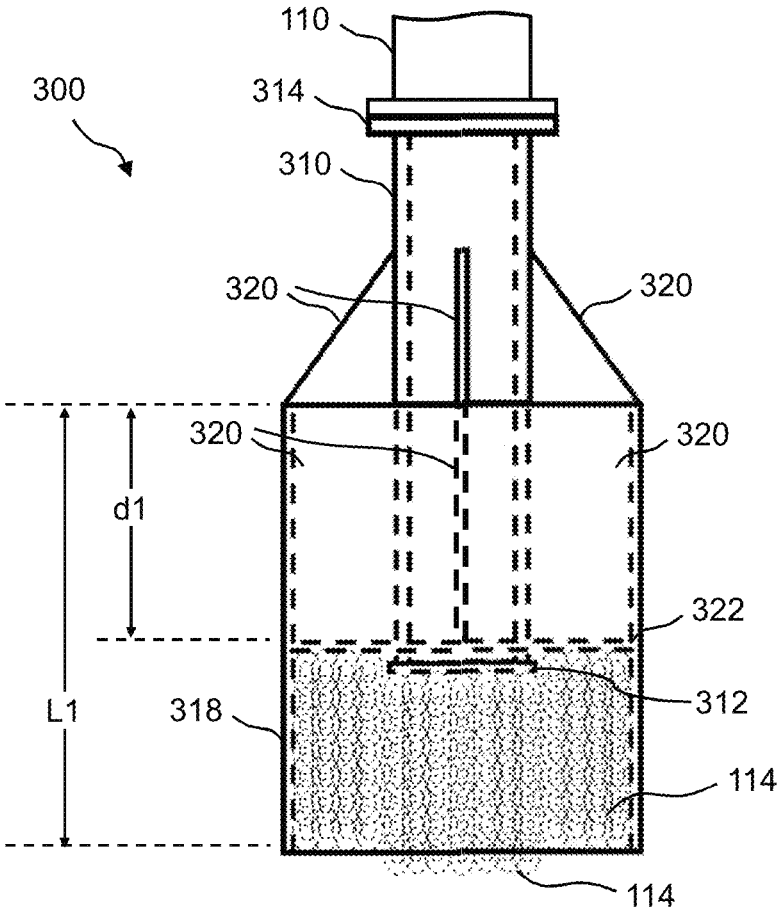
Figure 8B:
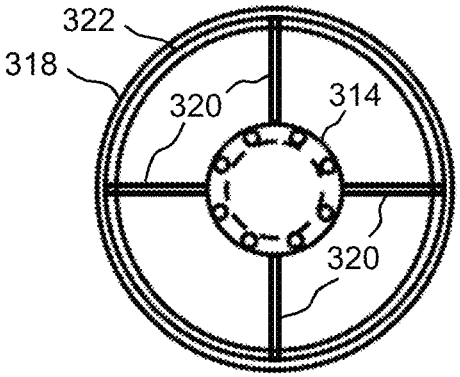
Figure 8C:
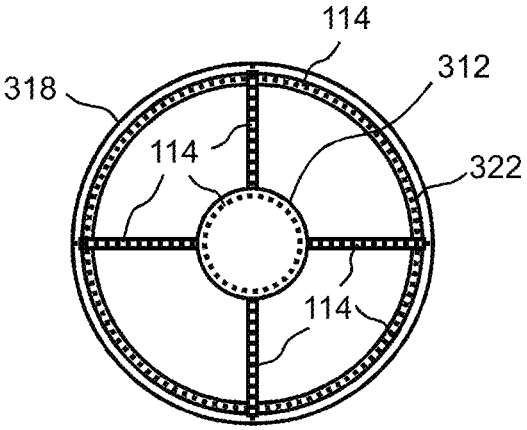
Figure 9A:
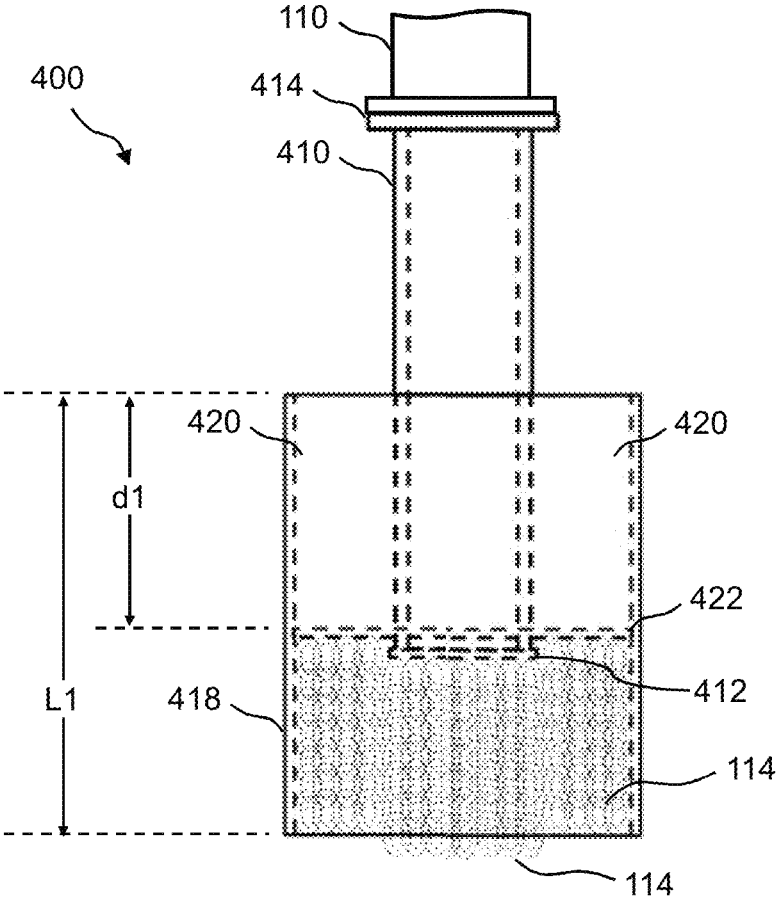
Figure 9B:
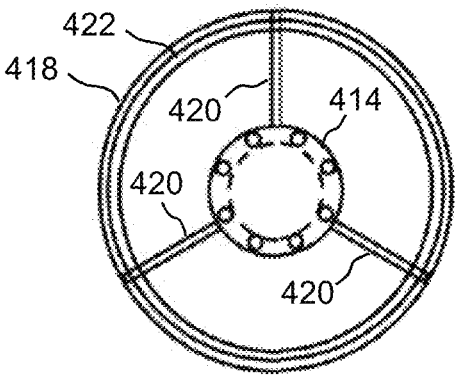
Figure 9C:
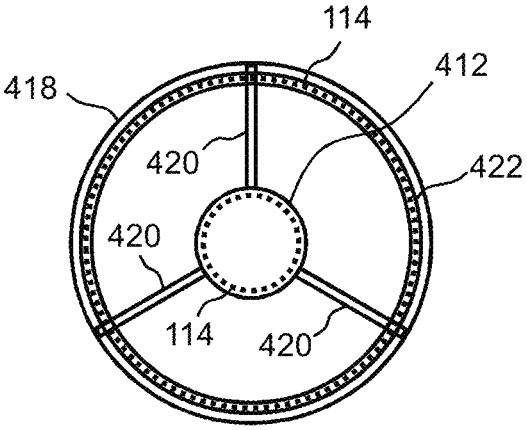
Figure 10:
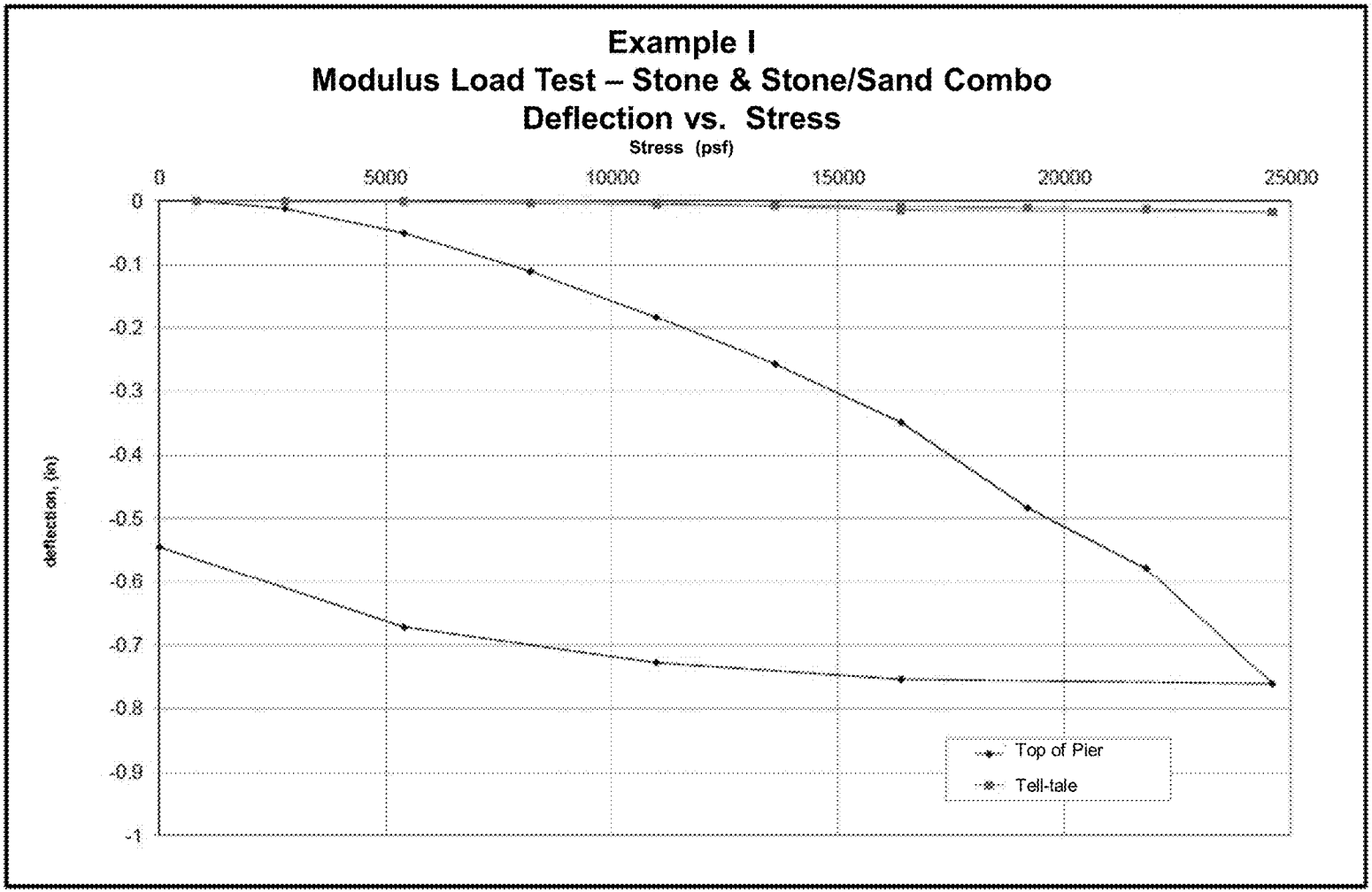
Figure 11:
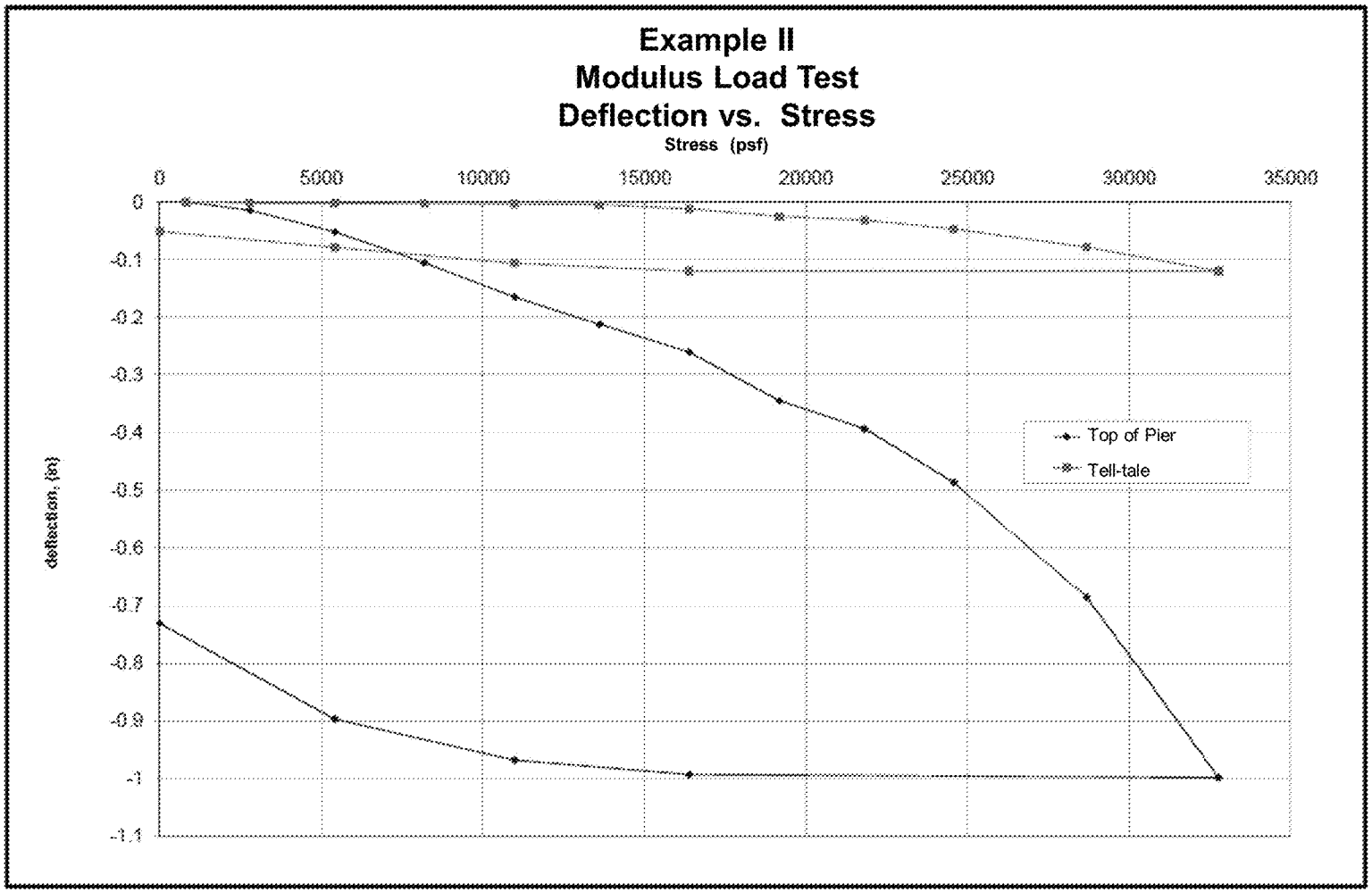
Figure 12A:
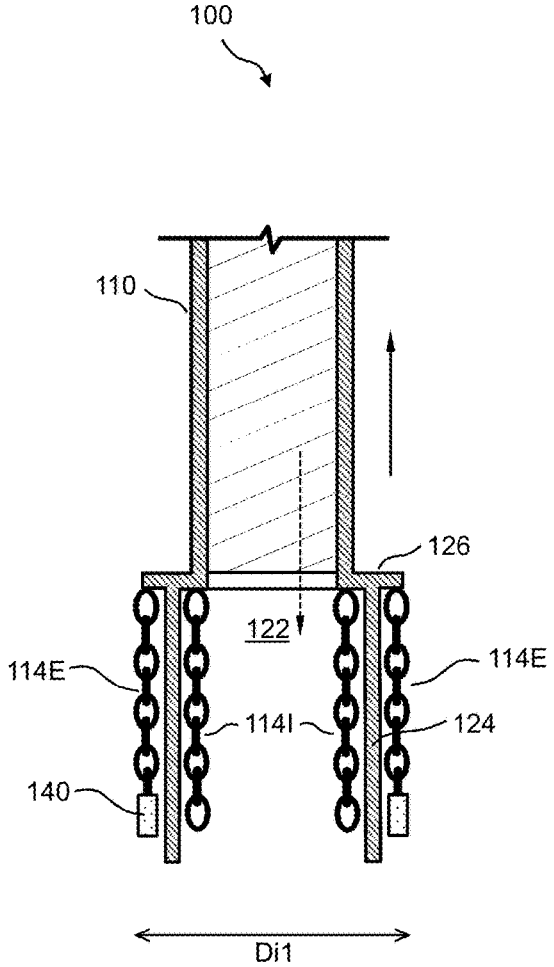
Figure 12B:
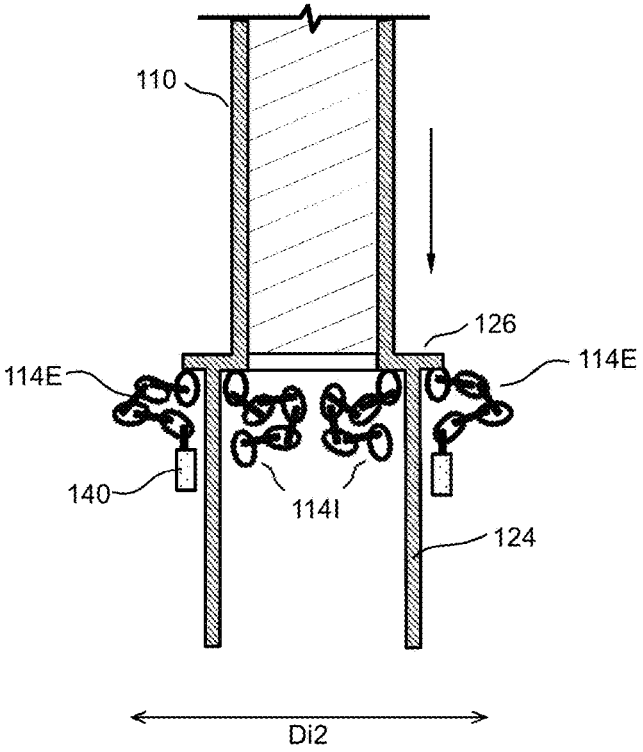
Figure 13A:
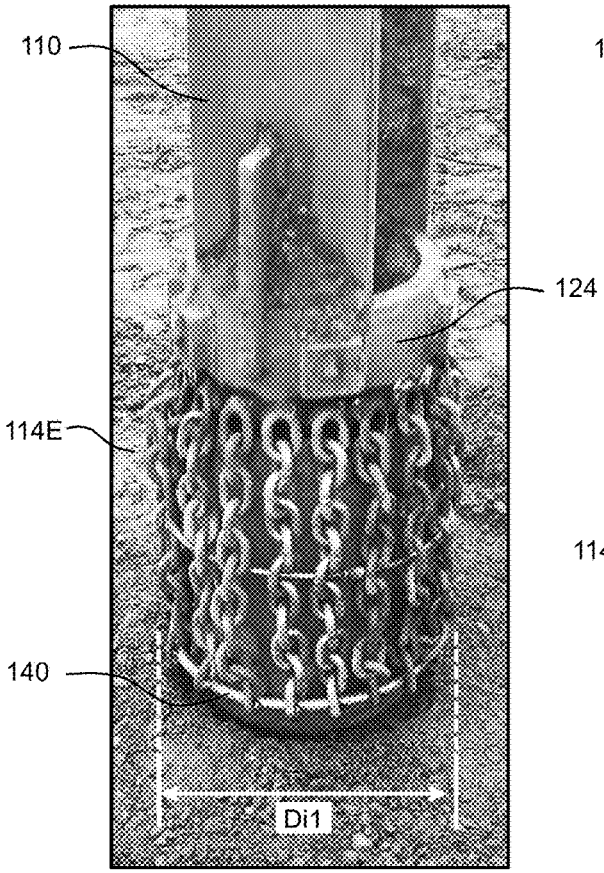
Figure 13B:
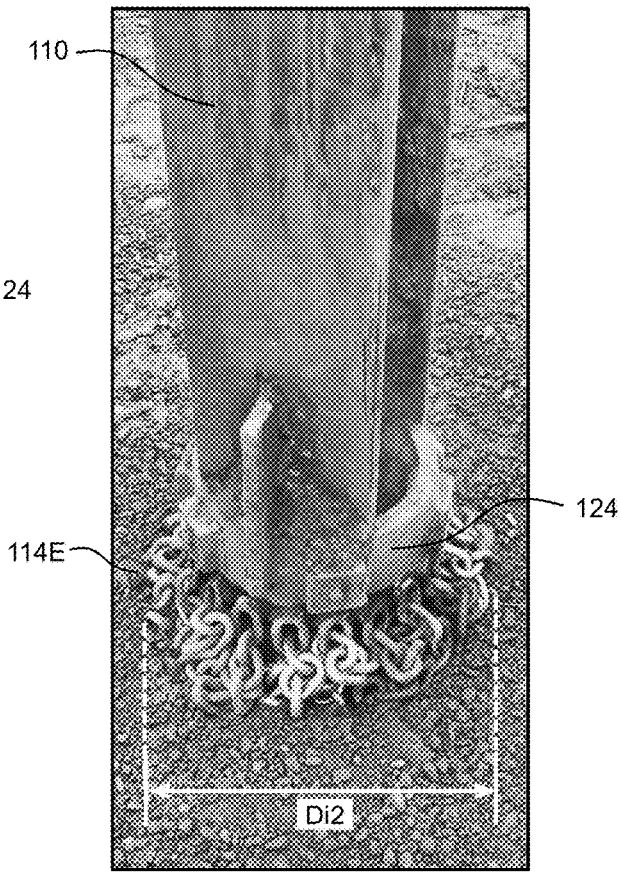
Figure 14A:
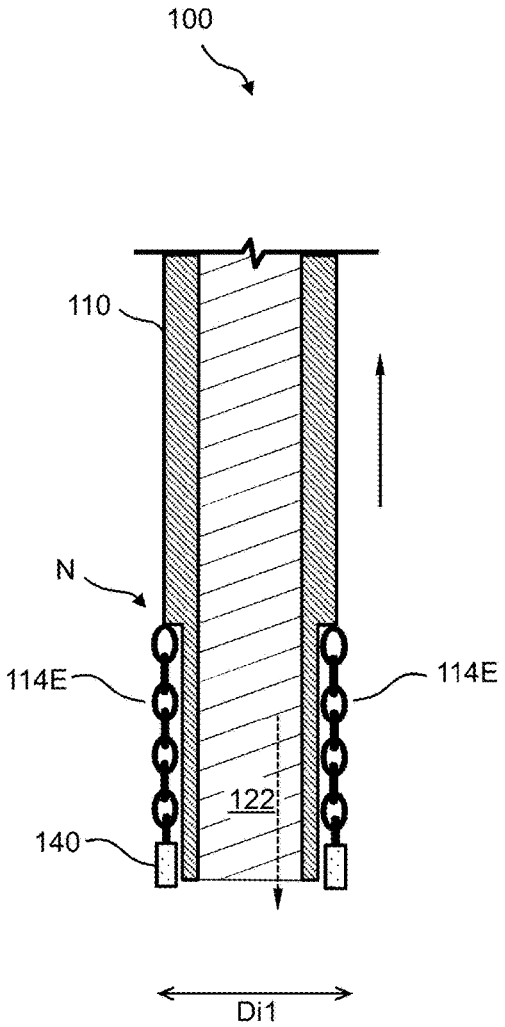
Figure 14B:
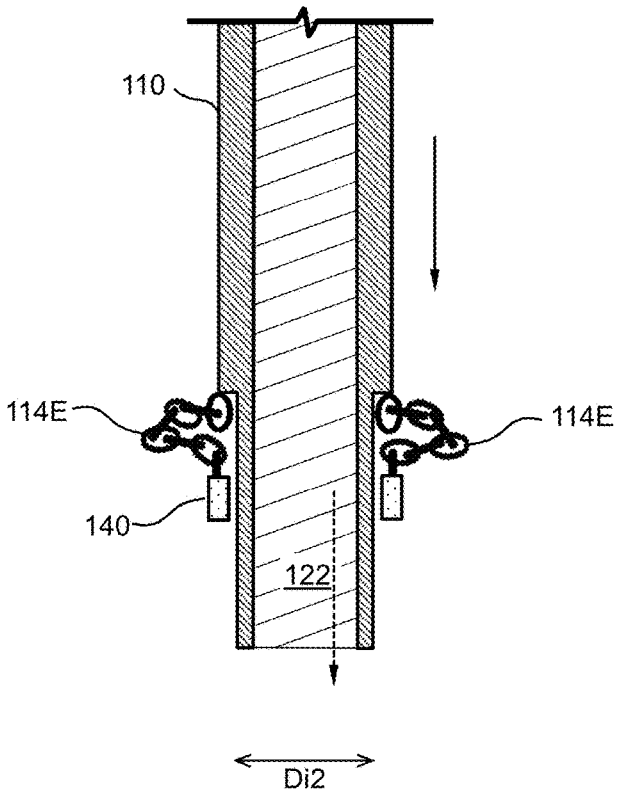
Figure 15A:
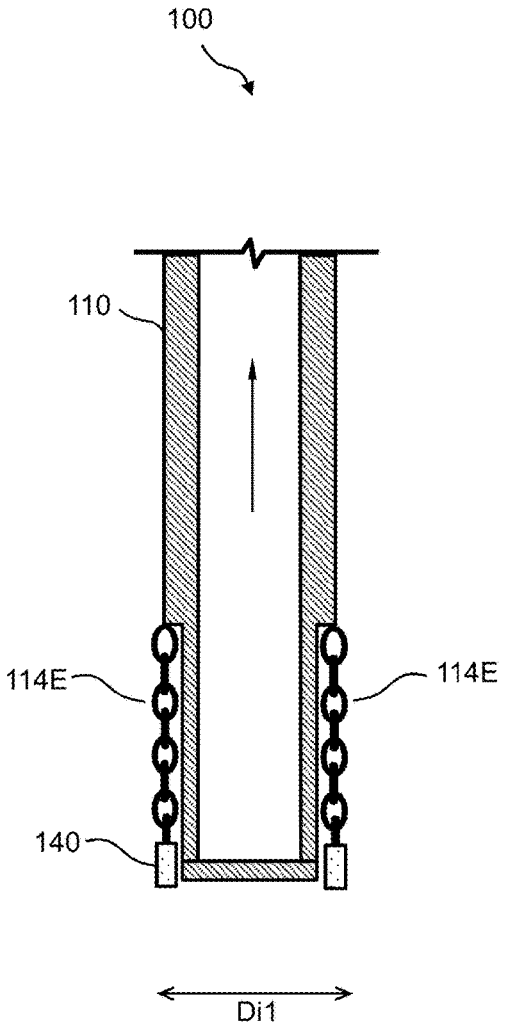
Figure 15B:
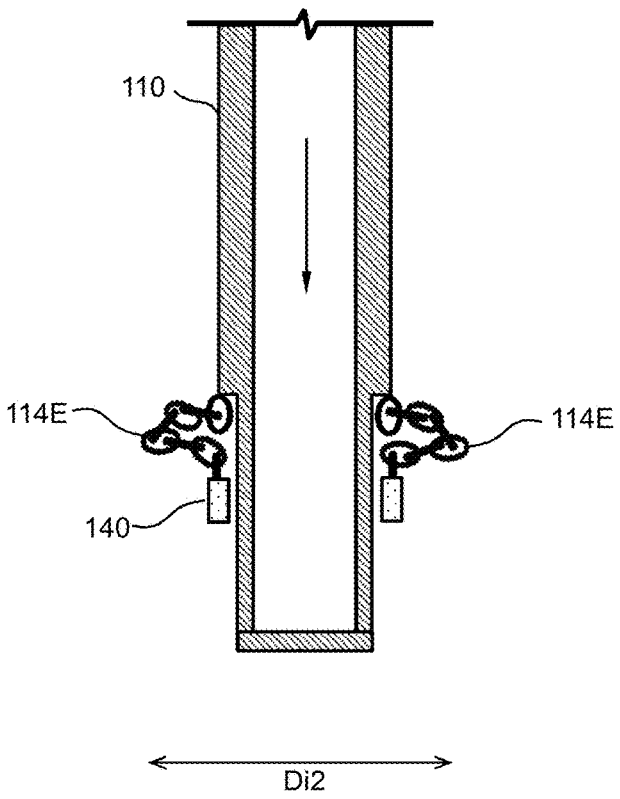
Figure 16A:
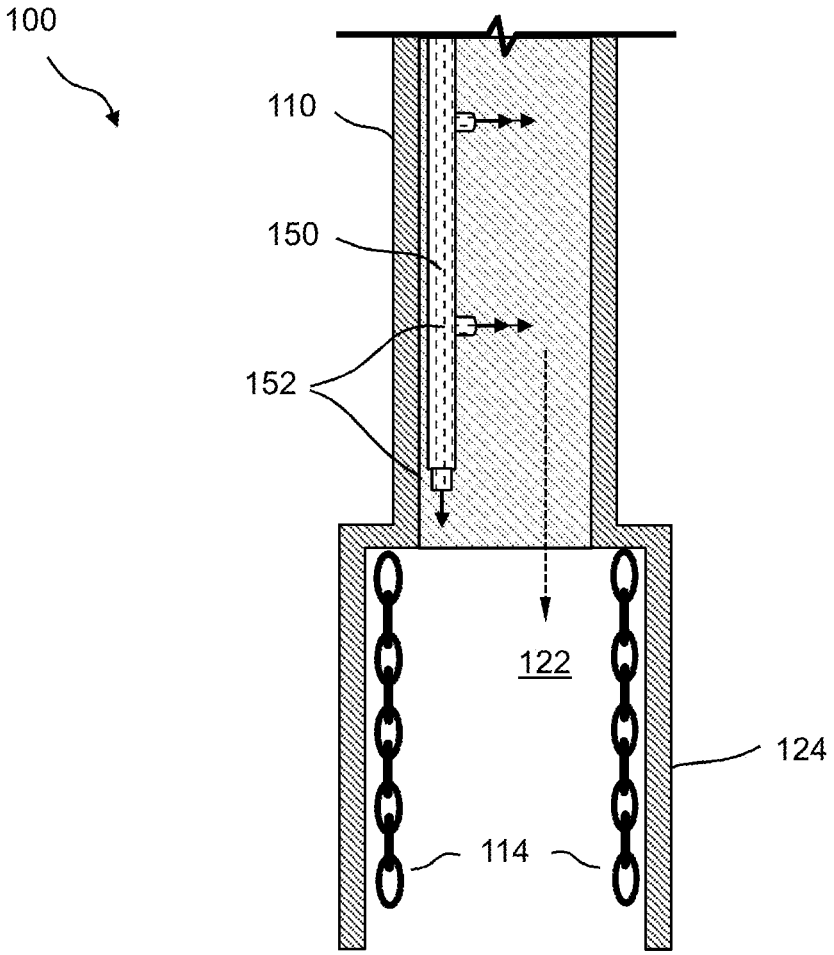
Figure 16B:
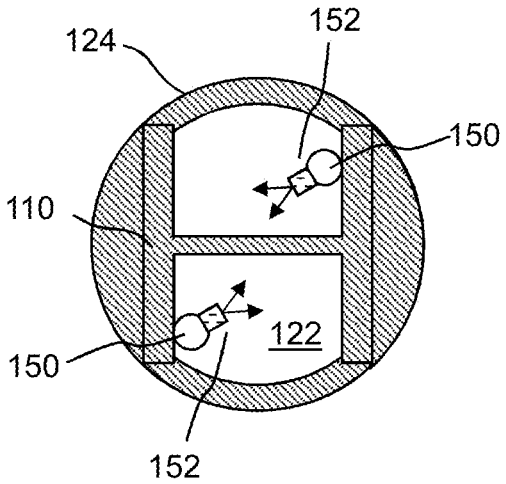
Figure 17A:
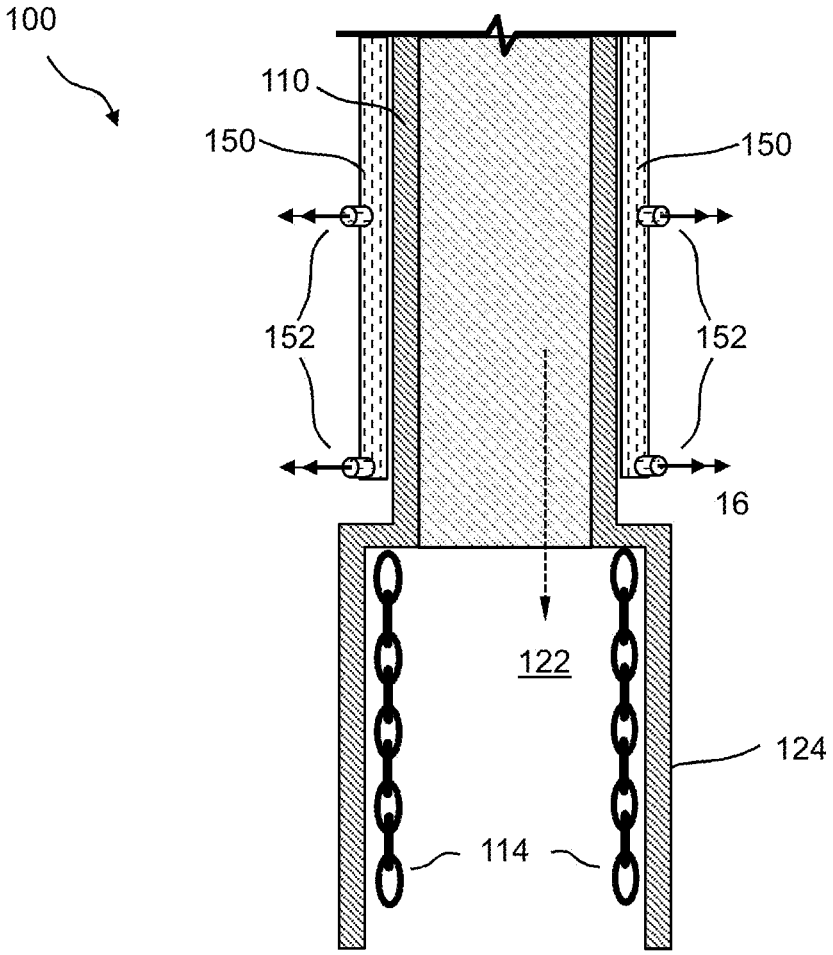
Figure 17B:
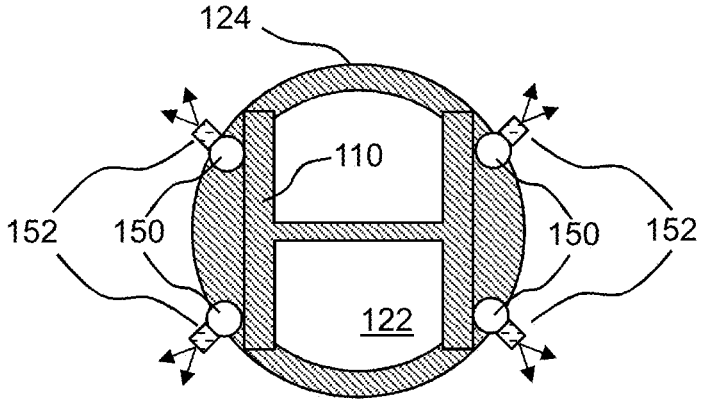
Figure 18:
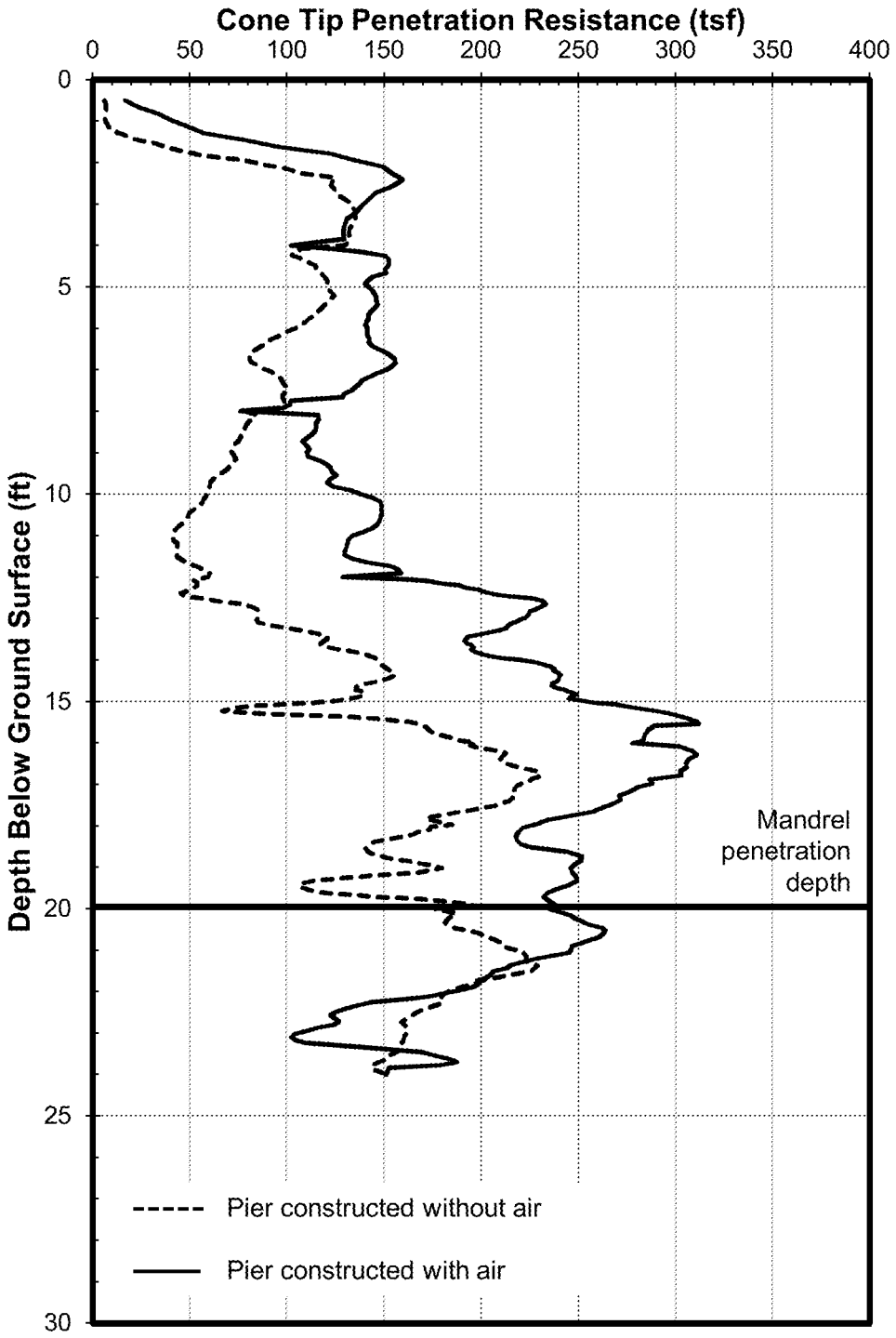

Having thus described the presently disclosed subject matter in general terms, reference will now be made to the accompanying Drawings, which are not necessarily drawn to scale, and wherein:

FIG. 1A and FIG. 1B illustrate side views of an example of the presently disclosed soil compaction apparatus in the raised and lowered positions, respectively, and comprising an arrangement of diametric expansion elements;

FIG. 2 illustrates a side view of the soil compaction apparatus of FIG. 1A and FIG. 1B and further comprising a sacrificial tip;

FIG. 3A and FIG. 3B illustrate a side view and a plan view, respectively, of yet another example of the presently disclosed soil compaction apparatus comprising yet another arrangement of diametric expansion/restriction elements;

FIG. 4A and FIG. 4B illustrate a side view and a plan view, respectively, of yet another example of the presently disclosed soil compaction apparatus comprising another arrangement of diametric restriction elements;

FIG. 5 illustrates a side view of the soil compaction apparatus of FIG. 4A and FIG. 4B wherein the apparatus is used to compact granular materials within a preformed cavity;

FIG. 6 illustrates a side view of another example of a soil compaction apparatus comprising a removable ring of diametric restriction elements;

FIG. 7A and FIG. 7B illustrate a top view and a bottom view, respectively, of the soil compaction apparatus of FIG. 6;

FIG. 8A illustrates a side view of a soil compaction apparatus comprising the diametric restriction elements, according to yet another embodiment;

FIG. 8B and FIG. 8C illustrate a top view and a bottom view, respectively, of the soil compaction apparatus of FIG. 8A;

FIG. 9A illustrates a side view of a soil compaction apparatus comprising diametric restriction elements, according to yet another embodiment;

FIG. 9B and FIG. 9C illustrate a top view and a bottom view, respectively, of the soil compaction apparatus of FIG. 9A;

FIG. 10 shows a plot of the modulus load test for a 16-inch (40.6 cm) mandrel substantially similar to the mandrel of FIG. 6, FIG. 7A, and FIG. 7B in an EXAMPLE I;

FIG. 11 shows a plot of the modulus load test results for a 28-inch (71.1 cm) mandrel substantially similar to the mandrel of FIGS. 8A-8C in an EXAMPLE II;

FIG. 12A and FIG. 12B illustrate side views of a soil compaction apparatus of a further embodiment in the raised and lowered positions, respectively, and comprising an arrangement of separate diametric restriction and expansion elements;

FIG. 13A and FIG. 13B show illustrations of the raised and lowered positions of the apparatus described with reference to FIG. 12A and FIG. 12B, respectively;

FIG. 14A and FIG. 14B illustrate side views of an example of the presently disclosed soil compaction apparatus in the raised and lowered positions, respectively, and comprising an arrangement of diametric expansion elements and a feed tube with an internal flow passage;

FIG. 15A and FIG. 15B illustrate side views of an example of the presently disclosed soil compaction apparatus in the raised and lowered positions, respectively, and comprising an arrangement of diametric expansion elements and a closed-end drive shaft;

FIG. 16A and FIG. 16B illustrate a side view and a top view, respectively, of a soil compaction apparatus of a further embodiment comprising one or more interior air injection tubes for increasing interior aggregate flow;

FIG. 17A and FIG. 17B illustrate a side view and a top view, respectively, of a soil compaction apparatus of a further embodiment comprising one or more exterior air injection tubes for increasing exterior aggregate flow; and FIG. 18 shows a plot of the cone penetration resistance versus depth measured down the center of two piers where one pier was installed using the present invention with air injection tubes similar to the mandrel in FIG. 17A and FIG. 17B and the other pier was installed using the soil compaction apparatus without air injection tubes.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides methods and apparatuses for compacting soil and granular materials that are either naturally deposited or consist of man-placed fill materials for the subsequent support of structures, such as buildings, foundations, floor slabs, walls, embankments, pavements, and other improvements. Namely, the presently disclosed subject matter provides various embodiments of soil compaction apparatuses in which each soil compaction apparatus includes an arrangement of diametric expansion/restriction elements. The diametric expansion/restriction elements can be fabricated from, for example, individual chains, cables, or wire rope, or a lattice of vertically and horizontally connected chains, cables, or wire rope. In a specific example, the diametric expansion/restriction elements can be formed of half-inch, grade 100 alloy chains.

Embodiments of the soil compaction apparatus include, but are not limited to, closed-ended driving shafts, open-ended driving shafts, flow-through passages, no flow-through passages, removable rings for holding the diametric expansion/restriction elements, and any combinations thereof.

In an example method of using the presently disclosed soil compaction apparatus, after initial driving, the soil compaction apparatus is raised and the diametric expansion elements hang freely by gravity from the bottom of the driving shaft. As the driving shaft is raised the free-field soils flow into the cavity left by the driving shaft. After raising the driving shaft the prescribed distance, the driving shaft is then re-driven downwardly to a depth preferably less than the initial driving depth into the underlying materials. This allows the diametric expansion elements the opportunity to expand radially, forming a compaction surface that has a diameter larger than the driving shaft. This process creates a well compacted column of densified soil below and around the diametric expansion elements. This process of lifting the driving shaft upward and driving back down is repeated incrementally until the driving shaft has been lifted to or near an original ground elevation.

Referring now to FIG. 1A and FIG. 1B, a soil compaction apparatus 100 according to one embodiment is illustrated, wherein the soil compaction apparatus 100 is used to compact granular materials. Namely, FIG. 1A and FIG. 1B are side views of the presently disclosed soil compaction apparatus 100 in the raised and lowered positions, respectively, and comprising an arrangement of diametric expansion elements 114. The soil compaction apparatus 100 shown in FIG. 1A and FIG. 1B may be inserted or driven into free-field soils (i.e., soil that exists in its natural or placed state below grade). The soil compaction apparatus 100 comprises a driving shaft 110. In this example, the driving shaft 110 is a closed-top and closed-end driving shaft. Namely, a base plate 112 is provided at the end of the driving shaft 110 that is driven into the soil, thereby forming the closed-end or closed-bottom driving shaft.

Further, an arrangement of diametric expansion elements 114 are attached to the bottom of the driving shaft 110 via, for example, a mounting plate 116. For example, the diametric expansion elements 114 can be fastened to the mounting plate 116. Then, the mounting plate 116 can be bolted to the base plate 112. In this example, the diametric expansion elements 114 are located at the closed bottom of the driving shaft 110 that is used to compact granular materials.

The diametric expansion elements 114 can be fabricated from individual chains, cables, wire rope, or the like, or a lattice of vertically and horizontally connected chains, cables, wire rope, or the like. In a specific example, the diametric expansion elements 114 are half-inch, grade 100 alloy chains. In the embodiment shown in FIG. 1A and FIG. 1B, when the soil compaction apparatus 100 is initially driven downward into free-field soil, the diametric expansion elements 114 may be placed within a sacrificial tip 118, as shown in FIG. 2. The sacrificial tip 118 may have a depth enough, such as 6 inches (15.2 cm), to house the diametric expansion elements 114.

After initial driving (see FIG. 1B), the soil compaction apparatus 100 is raised and the diametric expansion elements 114 hang freely by gravity from the bottom of the driving shaft 110 (see FIG. 1A). As the driving shaft 110 is raised the free-field soils (or additionally added aggregate) flow into the cavity left by the driving shaft 110. Optionally, one or more wings 120 are attached to the outer sides of the driving shaft 110. The wings 120 can act to loosen the free-field soils around the driving shaft 110.

After raising the driving shaft 110 the prescribed distance, the driving shaft 110 is then re-driven downwardly to a depth preferably less than the initial driving depth into the underlying materials. This allows the diametric expansion elements 114 the opportunity to expand radially (see FIG. 1B) forming a compaction surface CS that has a diameter larger than the base plate 112. In one example, the diameter Di1 of the driving shaft 110 and base plate 112 is about 12 inches (30.5 cm), while the diameter Di2 of the expanded compaction surface is about 18 inches (45.7 cm). The process creates a well-compacted column of densified soil below and around the diametric expansion elements 114. This process of lifting the driving shaft 110 upward and driving back down is repeated incrementally until the driving shaft 110 has been lifted to or near an original ground elevation.

The diametric expansion elements 114 are configured and sized accordingly to achieve the desired lift thickness, compaction surface area, and soil flow based on the material type and project requirements. The base plate 112 and the diametric expansion elements 114 (with mounting plate 116) are typically changeable. The configuration of the changeable base plate 112 with the attached diametric expansion elements 114 can be adapted to project requirements, which eliminates having to make separate drive shaft mandrels and is therefore a low cost and effective method. The soil compaction apparatus 100 shown in FIG. 1A and FIG. 1B has the advantage of being simple to fabricate, construct, and maintain.

Referring now to FIG. 3A and FIG. 3B, a side view and a plan view, respectively, of yet another example of the presently disclosed soil compaction apparatus 100 is illustrated comprising yet another arrangement of diametric expansion/restriction elements 114. In this example, a flow-through passage 122 around the driving shaft 110 and within a compaction chamber 124 facilitates aggregate flow into the compaction chamber 124 from an exterior of the driving shaft 110. In one example, the driving shaft 110 is an I-beam or H-beam that provides the "flow-through" arrangement, wherein soil can flow through the driving shaft 110 and into the flow-through passages 122 of the I-beam or H-beam (and compaction chamber 124). In the case of an H-beam being used as the driving shaft 110, the outer two flanges on the H-beam can also help case the soil cavity walls while the mandrel is being lowered and raised in the cavity. It is also contemplated that the driving shaft 110 can be a solid cylindrical shaft (with struts or similar connections to the compaction chamber) or the like.

The soil compaction apparatus 100 shown in FIG. 3A and FIG. 3B further comprises a compaction chamber 124. Namely, the compaction chamber 124 is mechanically connected to the bottom end of the driving shaft 110. The compaction chamber 124 is, for example, cylinder-shaped. The compaction chamber 124 may be the same size or diameter as the driving shaft 110 or the compaction chamber 124 may be larger or smaller than the driving shaft 110. In FIG. 3A and FIG. 3B, the compaction chamber 124 is larger in cross-sectional area than the driving shaft 110. In one example, the length of the compaction chamber 124 is about 24 inches (61.0 cm).

The compaction chamber 124 may be connected to the driving shaft 110 with a load transfer plate 126 with the optional use of one or more stiffener plates 128. The compaction chamber 124 may be open at its lower surface allowing for the intrusion of granular materials into the compaction chamber 124 when the soil compaction apparatus 100 is driven downwards. In the embodiment shown in FIG. 3A and FIG. 3B, the compaction chamber 124 may also be generally open at its upper surface facilitating the flow-through passage(s) 122. Namely, the load transfer plate 126 can be a ring-shape plate with an opening in the center portion thereof.

Further, in the embodiment shown in FIG. 3A and FIG. 3B, both interior diametric restriction elements 1141 and exterior diametric expansion elements 114E are attached to the load transfer plate 126. In this example, interior diametric "restriction" elements 1141 means interior to the compaction chamber 124 and exterior diametric "expansion" elements 114E means exterior to the compaction chamber 124. The interior diametric restriction elements 1141 and exterior diametric expansion elements 114E may or may not be connected to one another. The diametric expansion/restriction elements 114 (generally including interior diametric restriction elements 1141 and exterior diametric expansion elements 114E) typically may consist of individual chain links, cable, or of wire rope or a lattice of connected elements that hang downward from the load transfer plate 126. In a specific example, the diametric expansion/restriction elements 114 are half-inch, grade 100 alloy chains.

In the embodiment shown in FIG. 3A and FIG. 3B, the soil compaction apparatus 100 can be used to compact and densify granular soils in the free field or within a predrilled cavity. When the soil compaction apparatus 100 is extracted upwards through the free field soil or within a preformed cavity, the diametric expansion/restriction elements 114 hang vertically downward and offer little resistance to the upward movement of the soil compaction apparatus 100. When the soil compaction apparatus 100 is driven downward, the diametric expansion/restriction elements 114 engage the materials that the soil compaction apparatus 100 is being driven into because these materials (i.e., free field soil or aggregate placed in a predrilled hole) are moving upwards relative to the downwardly driven soil compaction apparatus 100.

The engaged materials cause the diametric expansion/restriction elements 114 to "expand" or "bunch" together, thereby substantially inhibiting any further upward movement of the soil or aggregate materials. The interior diametric restriction elements 1141 thus "bunch" in the interior of the compaction chamber 124 causing the compaction chamber 124 to "plug" with the upwardly moving soil material during downward movements of the mandrel. This creates an effective compaction surface CS that is then used to compact the materials directly below the bottom of the soil compaction apparatus 100. The exterior diametric expansion elements 114E likewise "expand" exterior of the compaction chamber 124 thus inhibiting the upward movement of the soil or aggregate materials exterior to the compaction chamber. This mechanism thus effectively increases the cross-sectional area of the compaction surface CS during downward compaction strokes. The increase in cross-sectional area allows for the use of the soil compaction apparatus 100 with an effective cross-sectional area that is larger during compaction than during extraction, offering great efficiency and machinery and tooling cost savings during construction.

Referring now to FIG. 4A and FIG. 4B, a side view and a plan view, respectively, are illustrated of yet another example of the presently disclosed soil compaction apparatus 100 comprising yet another arrangement of diametric restriction elements 114. The soil compaction apparatus 100 shown in FIG. 4A and FIG. 4B is substantially the same as the soil compaction apparatus 100 shown in FIG. 3A and FIG. 3B, except that it does not include the exterior diametric expansion elements 114E. In this example, the load transfer plate 126 does not extend beyond the diameter of the compaction chamber 124 and only the interior diametric restriction elements 1141 are attached thereto. Both of the soil compaction apparatuses 100 shown in FIG. 3A, FIG. 3B, FIG. 4A, and FIG. 4B provide an efficient flow-through passage 122 in an arrangement exterior of the driving shaft 110 that allows for improved granular material flow into the compaction chamber 124.

In the soil compaction apparatus 100 shown in FIG. 4A and FIG. 4B, when the soil compaction apparatus 100 is raised, granular materials that are located above the top of the compaction chamber 124 may flow around the outside of the compaction chamber 124 and/or through or exterior of the driving shaft 110 and into flow-through passage 122 to enter the compaction chamber 124 from above. The ability of the granular materials to flow through the flow-through passage 122 allows the soil compaction apparatus 100 to be raised upwards with less extraction force and thus with greater efficiency (as opposed to a more generally "closed"

upper portion of the compaction chamber as seen in the prior art). After the soil compaction apparatus 100 is raised, it is then re-driven back downwards. The downward action allows the interior diametric restriction elements 1141 to "bunch" together thereby forming an effective plug that is then used to compact the materials below the bottom of the soil compaction apparatus 100.

The soil compaction apparatus 100 shown in FIG. 4A and FIG. 4B is especially effective at densifying and compacting aggregates within preformed cavities. By way of example, FIG. 5 shows the soil compaction apparatus 100 shown in FIG. 4A and FIG. 4B in a cavity 130, wherein the soil compaction apparatus 100 is used to compact granular materials within a preformed cavity. In this example, the soil compaction apparatus compaction chamber 124 has a height H of approximately 24 inches (61.0 cm).

In an exemplary method, the cavity 130 is formed by drilling or other means and the soil compaction apparatus 100 is lowered into the cavity 130. Aggregate may then be poured from the ground surface to form a mound on top of the compaction chamber 124 within the cavity 130. When the soil compaction apparatus 100 is raised, the aggregate may then flow through and around the flow-through passage 122 and into the interior of the compaction chamber 124. Further raising the soil compaction apparatus 100 allows aggregate to flow below the bottom of the compaction chamber 124. When the soil compaction apparatus 100 is driven downwards into the placed aggregate, the interior diametric restriction elements 1141 move inwardly to "bunch" together to form a compaction surface. This mechanism facilitates the compaction of the aggregate materials below the compaction chamber 124. The soil compaction apparatus 100 and method described above for this embodiment allows the soil compaction apparatus 100 to remain in the cavity 130 during the upward and downward movements required for the compaction cycle and eliminates the need to "trip" the mandrel out of the cavity 130 as is required for previous art. The soil compaction apparatus 100 and method further eliminate the need for a hollow feed tube and hopper that is typically required for displacement methods used in the field and described above. Another advantage of the open flow-through passage 122 in the upper portion of the compaction chamber 124 is the ability to develop a head of stone above the compaction chamber to temporarily case the caving cavity soils during pier construction, while being able to leave the mandrel in the cavity while aggregate is added.

The soil compaction apparatuses 100 shown in FIG. 1A through FIG. 3B may also be used in conjunction with the method for compacting and densifying aggregate in pre-drilled holes as described above in FIG. 4A, FIG. 4B, and FIG. 5. When the soil compaction apparatuses 100 shown in FIG. 1A through FIG. 3B are used, the exterior diametric expansion elements 114 hang downwards during upward extraction and expand/bunch together during the downward compaction stroke. This prevents the aggregate below from moving upwards relative to the exterior of the driving shaft 110 and/or the compaction chamber 124. The prevention of upward movements allows a tamper head to effectively enlarge during the compaction of the aggregate. A larger sized tamper head provides greater confinement to the lift of aggregate placed and effectively densifies a greater depth of aggregate within the lift that is placed. This mechanism allows for the use of thicker lifts of aggregate during compaction, making the process less costly and more efficient.

Referring now to FIG. 6, a side view of another soil compaction apparatus 200 is illustrated comprising a removable ring of diametric restriction elements (defined in further detail hereinbelow), according to another embodiment. FIG. 7A and FIG. 7B illustrate a top view and a bottom view, respectively, of the soil compaction apparatus 200 of FIG. 6.

The soil compaction apparatus 200 includes a driving shaft 210. The driving shaft 210 is typically an I-beam or H-beam that provides a "flow-through" arrangement, wherein soil/aggregate can flow through or exterior of the driving shaft 210 and into the flow-through passages 122 of the I-beam or H-beam (see FIG. 7A and FIG. 7B). In one example, the I-beam or H-beam has a height of about 11.5 inches (29.2 cm), a width of about 10.375 inches (26.4 cm), and a length of about 112 inches (2.84 m). An opening 212 may be provided in the web of the I-beam or H-beam that forms the driving shaft 210 to allow aggregate or other materials in the cavity above the bottom end of the drive shaft to pass from one half of the cavity to the other. The opening 212 may be near the bottom end of the driving shaft 210. In one example, the opening 212 has rounded ends and is about 24 inches (61.0 cm) long and about 6 inches (15.2 cm) wide. To overcome any loss of strength in the driving shaft 210 due to the presence of the opening 212, a pair of reinforcing plates 214 can be, for example, welded to the driving shaft 210, i.e., one reinforcing plate 214 on one side and another reinforcing plate 214 on the other side near the opening 212. In one example, each reinforcing plate 214 is about 5 inches (12.7 cm) wide and about 1 inch (2.5 cm) thick.

In soil compaction apparatus 200, the bottom end of the driving shaft 210 is fitted into one end of a pipe 216 such that a portion of the opening 212 is inside the pipe 216. Namely, the driving shaft 210 is fitted into the pipe 216 to a depth d1. In one example, the depth d1 is about 11 inches (27.9 cm). Once fitted into the pipe 216, the driving shaft 210 can be secured therein by, for example, welding. In one example, the pipe 216 has a length L1 of about 36 inches (91.4 cm), an outside diameter (OD) of about 16 inches (40.6 cm), an inside diameter (ID) of about 14 inches (35.6 cm), and thus a wall thickness of about 1 inch (2.5 cm).

Fitted around the bottom end of the pipe 216 can be a reinforcing ring 218. In one example, the reinforcing ring 218 has a height h1 of about 3 inches (7.6 cm), an OD of about 18 inches (45.7 cm), an ID of about 16 inches (40.6 cm), and thus a wall thickness of about 1 inch (2.5 cm). In one example, the reinforcing ring 218 can be secured to the pipe 216 by welding. Further, a ring-shaped wearing pad 220 can abut the end of the pipe 216 and the reinforcing ring 218. In one example, the wearing pad 220 has a thickness t1 of about 1 inch (2.5 cm). The wearing pad 220 may be replaced as needed. The soil compaction apparatus 200 also typically comprises a removable ring 222 to which an arrangement of the diametric restriction elements 114 is attached. In one example, the removable ring 222 has a height of from about 3 inches (7.6 cm) to about 4 inches (10.2 cm), an OD of about 14 inches (35.6 cm), an ID of about 13 inches (33.0 cm), and thus a wall thickness of about 0.5 inches (1.3 cm). By attaching the diametric restriction elements 114 to the removable ring 222, a removable ring of the diametric restriction elements 114 is formed. The removable ring 222 with the diametric restriction elements 114 may be fitted inside of the pipe 216 and positioned near the end of the driving shaft 210 such that the diametric restriction elements 114 hang down toward the bottom end of the pipe 216. The removable ring 222 can be secured inside the pipe 216 by, for example, bolts 224.

Another set of diametric restriction elements 114 can be secured to the web of the I-beam or H-beam that forms the driving shaft 210. Hereafter, the diametric restriction elements 114 attached to the removable ring 222 are called the diametric restriction elements 114A. Hereafter, the diametric restriction elements 114 attached to the web of the driving shaft 210 are called the diametric restriction elements 114B.

In one example, the removable ring 222 can be a single-piece continuous ring. In this example, the diametric restriction elements 114A are formed, for example, by welding twenty-six (26), 14-inch (35.6 cm) long, half-inch (1.3 cm), grade 100 alloy chains to the removable ring 222. In another example, the removable ring 222 can consist of two half-rings that are positioned together inside of the pipe 216. In this example, the diametric restriction elements 114A are formed, for example, by welding thirteen (13), 14-inch (35.6 cm) long, half-inch (1.3 cm), grade 100 alloy chains to each half of the removable ring 222.

In one example, the diametric restriction elements 114B attached to the web of driving shaft 210 are formed by welding five (5), 14-inch (35.6 cm) long, half-inch (1.3 cm), grade 100 alloy chains to the web of the I-beam or H-beam that forms the driving shaft 210. When the mandrel is driven into the aggregate, the chains bunch-up, thereby substantially restricting the flow of aggregate upward and allowing the mandrel to compact the aggregate. When the mandrel is extracted, the chains fall, allowing aggregate to flow downward relative to the mandrel.

Referring now to FIG. 8A, a side view of a soil compaction apparatus 300 is illustrated comprising the diametric restriction elements 114, according to another embodiment. FIG. 8B and FIG. 8C illustrate a top view and a bottom view, respectively, of the soil compaction apparatus 300 of FIG. 8A. In this example, the soil compaction apparatus 300 can comprise a pipe 310. The bottom end of the pipe 310 may be closed using a plate or cap 312, thereby rendering the pipe 310 a closed-end pipe. The top end of the pipe 310 typically has a flange 314 for connecting to the tip of the driving shaft 110. In one example, the pipe 310 is about 40 inches (101.6 cm) long and has an OD of about 10 inches (25.4 cm), an ID of about 8 inches (20.3 cm), and thus a wall thickness of about 1 inch (2.5 cm). The pipe 310, the plate or cap 312, and the flange 314 can be fastened together by, for example, welding.

The bottom end of the closed-end pipe 310 is fitted into one end of a compaction chamber 318. In one example, the compaction chamber 318 is a pipe that has a length L1 of about 40 inches (101.6 cm), an OD of about 33.5 inches (85.1 cm), an ID of about 31.5 inches (80.0 cm), and thus a wall thickness of about 1 inch (2.5 cm). In one example, the pipe 310 is fitted into the compaction chamber 318 a distance of about 21 inches (53.3 cm).

The pipe 310 may be supported within the compaction chamber 318 by, for example, four struts or plates 320 arranged radially around the pipe 310 (e.g., one at 12 o'clock, one at 3 o'clock, one at 6 o'clock, and one at 9 o'clock). In one example, the struts or plates 320 are about 1 inch (2.5 cm) thick. The struts or plates 320 typically extend into the compaction chamber 318 a distance d1, or for example, about 19 inches (48.3 cm). The top end of the struts or plates 320 can be tapered toward the pipe 310 as shown, whereas the lower ends of the struts or plates 320 are typically squared off. Alternatively, the struts or plates 320 may be squared off at the top similar to the lower end. The plate or cap 312 at the end of the pipe 310 may extend slightly below the lower end of the struts or plates 320. The pipe 310, the compaction chamber 318, and the struts or plates 320 can be fastened together by, for example, welding.

Further, a ring 322 may be provided inside of the compaction chamber 318 and near the lower end of the struts or plates 320. In one example, the ring 322 has a height of about 2 inches (5.1 cm), an OD of about 31.5 inches (80.0 cm), an ID of about 29.5 inches (74.9 cm), and thus a wall thickness of about 1 inch (2.5 cm). The ring 322 can be fastened inside of the compaction chamber 318 by, for example, welding or bolting.

As shown in FIG. 8C, the diametric restriction elements 114 may be attached to and hang down from the lower surface of the ring 322, the lower edges of the four struts or plates 320, and around the perimeter of the plate or cap 312. The diametric restriction elements 114 can be fabricated from individual chains, cables, or wire rope, or a lattice of vertically and horizontally connected chains, cables, or wire rope. In a specific example, the diametric restriction elements 114 are 19-inches (48.3 cm) long, half-inch (1.3 cm), grade 100 alloy chains that are welded to the ring 322, the struts or plates 320, and the plate or cap 312.

Referring now to FIG. 9A, a side view of a soil compaction apparatus 400 is illustrated comprising the diametric restriction elements 114, according to another embodiment. FIG. 9B and FIG. 9C illustrate a top view and a bottom view, respectively, of the soil compaction apparatus 400 of FIG. 9A.

In this example, the soil compaction apparatus 400 typically comprises a drive pipe 410. The bottom end of the drive pipe 410 may be closed using a plate or cap 412, thereby rendering the drive pipe 410 a closed-end pipe. The top end of the drive pipe 410 typically has a flange 414 for connecting to the tip of the driving shaft 110. In one example, the drive pipe 410 is about 40 inches (101.6 cm) long and has an OD of about 7 inches (17.8 cm), an ID of about 5 inches (12.7 cm), and thus a wall thickness of about 1 inch (2.5 cm). The drive pipe 410, the plate or cap 412, and the flange 414 can be fastened together by, for example, welding.

The bottom end of the closed-end drive pipe 410 is fitted into one end of a compaction chamber 418. In one example, the compaction chamber 418 is a pipe that has a length L1 of about 40 inches (101.6 cm), an OD of about 27 inches (68.6 cm), an ID of about 25 inches (63.5 cm), and thus a wall thickness of about 1 inch (2.5 cm). In one example, the drive pipe 410 is extended into the compaction chamber 418 a distance of about 26 inches (66.0 cm).

The drive pipe 410 may be supported within the compaction chamber 418 by, for example, three struts or plates 420 arranged radially around the drive pipe 410 (e.g., one at 12 o'clock, one at 4 o'clock, and one at 8 o'clock). In one example, the struts or plates 420 are about 1 inch (2.5 cm) thick. The struts or plates 420 can extend into the compaction chamber 418 a distance d1, or for example, about 24 inches (61.0 cm). The top end of the struts or plates 420 can be squared off at about the top edge of the drive pipe 410 as shown. The lower end of the struts or plates 420 can be also be squared off. The plate or cap 412 at the end of the drive pipe 410 may extend slightly below the lower end of the struts or plates 420. The drive pipe 410, the compaction chamber 418, and the struts or plates 420 can be fastened together by, for example, welding.

Further, a ring 422 may be provided inside of the compaction chamber 418 and near the lower end of the struts or plates 420. In one example, the ring 422 has a height of about 2 inches (5.1 cm), an OD of about 25 inches (63.5 cm), an ID of about 23 inches (58.4 cm), and thus a wall thickness of about 1 inch (2.5 cm). The ring 422 can be fastened inside of the compaction chamber 418 by, for example, welding or bolting.

The diametric restriction elements 114 are typically attached to and hang down from the lower surface of the ring 422, around the perimeter of the plate or cap 412, and from the bottom of the struts 420. The diametric restriction elements 114 can be fabricated from individual chains, cables, or wire rope, or a lattice of vertically and horizontally connected chains, cables, or wire rope. In one example, there are thirty two (32), 14-inch (35.6 cm) long, half-inch (1.3 cm), grade 100 alloy chains welded to the ring 422 and fourteen (14), 20-inch (50.8 cm) long, half-inch (1.3 cm), grade 100 alloy chains welded to the plate or cap 412.

Exterior Ring Embodiment with Exterior and Internal Elements

Referring now to FIG. 12A and FIG. 12B, side views of the raised and lowered positions, respectively, of yet another example of the presently disclosed soil compaction apparatus 100 is illustrated comprising yet another arrangement of separate interior and exterior diametric restriction/expansion elements 1141 and 114E, respectively. The soil compaction apparatus 100 shown in FIG. 12A and FIG. 12B is substantially the same as the soil compaction apparatus 100 shown in FIG. 3A and FIG. 3B, except that the exterior diametric expansion elements 114E are not connected to the interior diametric restriction elements 1141. In this example, the exterior diametric expansion elements are mechanically fastened to the load transfer plate 126 that extends beyond the diameter of the compaction chamber 124 and attached to an exterior floating circumferential ring 140 that is free to translate in the vertical, up and down direction yet is constrained in the lateral, side-to-side direction.

In the soil compaction apparatus 100 shown in FIG. 12A and FIG. 12B, when the soil compaction apparatus 100 is raised, granular materials that are located above the top of the compaction chamber 124 may flow around the outside of the exterior diametric expansion elements 114E and/or through or exterior of the driving shaft 110 and into flow-through passage 122 to enter the compaction chamber 124 from above. The ability of the granular materials to flow through the flow-through passage 122 allows the soil compaction apparatus 100 to be raised upwards with less extraction force and thus with greater efficiency (as opposed to a more generally "closed" upper portion of the compaction chamber as seen in the prior art). After the soil compaction apparatus 100 is raised, it is then re-driven back downwards. The downward action allows the exterior floating ring 140 to translate up the outside of the compaction chamber 124 and further, allowing the diametric expansion elements to expand outwards thereby increasing the compaction diameter below the bottom of the apparatus 100.

The soil compaction apparatus 100 described in FIG. 12A and FIG. 12B is further illustrated in FIG. 13A and FIG. 13B. The raised position of the apparatus 100 is pictured in FIG. 13A. The increased compaction diameter achieved by the apparatus 100 in the lowered position is shown in FIG. 13B. In this example, there are twenty (20), 18-inch (45.7 cm) long, half-inch (1.3 cm), grade 100 alloy chains welded approximately 4 inches (10.2 cm) below the top of the compaction chamber 124 and connected by the exterior floating ring 140 hanging approximately 2 inches (5.1 cm) above the bottom of the soil compaction apparatus 100. In this example, the soil compaction apparatus has an exterior diameter in the raised position Di1 of 15 inches (38.1 cm) and an exterior diameter in the lowered position Di2 of about 20 inches (50.8 cm).

Exterior Only Embodiment

Referring now to FIG. 14A and FIG. 14B, side views of the raised and lowered positions, respectively, of yet another example of the presently disclosed soil compaction apparatus 100 is illustrated comprising yet another arrangement of exterior diametric expansion elements 114E. The soil compaction apparatus 100 shown in FIG. 14A and FIG. 14B can be substantially the same as the soil compaction apparatus 100 shown in FIG. 12A and FIG. 12B, except that the mandrel is designed such that only exterior diametric expansion elements 114E are present and are mechanically fasted to the drive shaft 110 in a different manner, such as attachment at a notch point N. Notch point N can consist of a notch formed between different wall thicknesses in the drive shaft, for example a first wall thickness formed in an upper portion of drive shaft 110 to form a first diameter Di1 and a second wall thickness formed in a lower portion of drive shaft 110 to form a second diameter Di2. A similar exterior floating circumferential ring 140 can be used at the terminal end of the exterior diametric expansion elements 114E and is free to translate in the vertical, up and down direction yet is constrained in the lateral, side-to-side direction. FIG. 14A and FIG. 14B depict use with a feed tube having an internal flow passage 122, whereas FIG. 15A and FIG. 15B depict use with a closed-end drive shaft but with a similar arrangement of exterior diametric expansion elements 114E.

Air Enhanced Embodiment

Referring now to FIG. 16A and FIG. 16B, a side view and a plan view, respectively, are illustrated of yet another example of the presently disclosed soil compaction apparatus 100, comprising at least one interior air injection tube 150 with at least one injection port 152 used to supply positive air pressure required to increase interior aggregate flow down the flow-through passage(s) 122.

In this example, the air injection tubes 150 are fastened to the inside flanges of the drive shaft 110 with multiple discharge ports 152 located above the compaction chamber 124. The air injection ports 152 may be directed towards the center of the drive shaft 110 or downwards along the drive shaft 110 to contain the flow of air pressure within the interior of the drive shaft 110. The supply of positive air pressure focused to the interior of the drive shaft 110 is useful to facilitate the flow of aggregate down through the flow-through passage(s) 122 to enter the compaction chamber 124 from above by reducing any aggregate bridging that may occur between the interior flanges of the drive shaft 110 and the side walls of preformed or displaced soil cavity. In one example, the air injection tube 150 has a nominal diameter of 0.75 inches (1.9 cm) with multiple air injection ports 152 of about 0.125 inches (3.18 mm) in diameter located more than 1 inch (2.54 cm) above the compaction chamber 124 and spaced approximately 3 feet (0.9 m) center-to-center along the length of the drive shaft 110.

A further embodiment of the presently disclosed soil compaction apparatus 100 is illustrated in a side view and a plan view in FIG. 17A and FIG. 17B, respectively. The soil compaction apparatus 100 shown in FIG. 17A and FIG. 17B is substantially the same as the soil compaction apparatus 100 shown in FIG. 16A and FIG. 16B, except that the air injection tubes 150 are located on the exterior flange of the drive shaft 110 and the injection ports 152 are directed outwards away from the drive shaft 110 to increase exterior aggregate flow.

In this example, the four air injection tubes 150 are fastened to the outside of the drive shaft flanges with multiple discharge ports 152 located above the compaction chamber 124 and directed outwards towards the free field soil. The supply of positive air pressure focused to the exterior of the drive shaft 110 is useful to induce caving of the granular free field soils into the cavity created by driving the soil compaction apparatus 100 into the ground. When the soil compaction apparatus 100 is raised, the caving granular materials may flow around the outside of the compaction chamber or between the driving shaft 110 flanges and into flow-through passage 122 to enter the compaction chamber 124 from above. When the soil compaction apparatus 100 is re-driven back downwards, the caving granular free field soils may then be compacted in place below the bottom of the apparatus 100. The ability of the exterior free field granular materials to flow into the compaction chamber 124 increases the volume of aggregate that can be compacted below ground.

Having generally described the invention, various embodiments are more specifically described by illustration in the following specific EXAMPLES, which further describe different embodiments of the soil compaction apparatus.

Example I

In one example, a method of compacting aggregate using an embodiment of the subject matter disclosed herein in a pre-drilled cavity was demonstrated in full-scale field tests. The compaction mandrel was comprised of an "I-beam" drive shaft with a 16-inch (40.6 cm) diameter flow-through compaction chamber at the bottom, similar to the soil compaction apparatus 200 shown in FIGS. 6, 7A, and 7B.

Test piers with a diameter of 20-inches (50.8 cm) were installed to a depth of 30 feet (9.1 m). The piers were constructed by drilling a cylindrical cavity to the specified depth. After drilling, stone aggregate was poured into the cavity until there was an approximate 3-foot thick lift of uncompacted stone at the bottom of the cavity. The mandrel was then lowered into the cavity until it reached the top of the stone. The hammer was started and the mandrel was lowered into the stone until the diametric restrictor elements on the bottom were engaged. The mandrel was then driven into the stone, both compacting the stone and driving the stone downward and laterally into the surrounding soil.

While the mandrel was in the cavity and compacting the bottom lift of stone, additional aggregate was poured into the cavity until the aggregate was approximately 10 feet (3.0 m) above the compaction head. The mandrel was then raised 6 feet (1.8 m), causing the diametric restrictor elements to unfurl and allowing the aggregate to pass through the compaction head (via the flow-through passages). The mandrel was then driven down into the aggregate 3 feet (0.9 m), causing the diametric restrictor elements to bind up and both compact the aggregate between the initial lift and compaction head and drive the aggregate laterally into the surrounding stone. The mandrel was then subsequently raised 6 feet (1.8 m) and lowered 3 feet (0.9 m) compacting each lift of aggregate in 3-foot (0.9 m) increments, until reaching the ground surface. The level of stone was maintained above the top of the compaction head throughout construction of the pier.

Modulus tests were performed on two of the constructed piers, one for a pier constructed to a depth of 30 feet (9.1 m) using clean, crushed stone and one to a depth of feet (9.1 m) with the bottom 10 feet (3.0 m) of compacted aggregate consisting of clean, crushed stone and the upper 20 feet (6.1 m) of compacted aggregate consisting of concrete sand. The results shown in plot 1000 of FIG. 10 indicate that the constructed piers confirmed the design and were sufficient to support the structure.

More than 5,000 piers were installed at this site with the technique described above. Traditional replacement methods such as those described in U.S. Pat. Nos. 5,249,892 and 6,354,766 were not feasible at this site because the drilled cavities were unstable below a depth of 10 feet (3.0 m). The installation method described herein allowed for the head of stone above the compaction chamber to temporarily case the caving soils during pier construction. The advantage of being able to leave the mandrel in the cavity as aggregate was added allowed for an average installation rate of approximately 145 feet (44.2 m) of pier per hour, a rate estimated to be approximately 30 percent faster than is typically observed for traditional replacement methods. Further, the present invention was advantageous over the displacement method described in U.S. Pat. No. 7,226,246 because it allowed for higher capacities to develop in the upper cohesive soils relative to displacement methods.

Example II

In another example of an embodiment of the subject matter disclosed herein, a method of compacting aggregate in a pre-drilled cavity with a mandrel having a 28-inch (71.1 cm) diameter flow-through compaction chamber similar to FIGS. 8A-8C was demonstrated in full scale field tests. A modulus test pier was constructed to verify the performance of the construction method.

The cavity for the test pier was drilled to a depth of 12 feet (3.7 m). After drilling, the mandrel was lowered into the cavity until the compaction chamber reached the bottom. Clean stone aggregate was poured into the cavity until there was enough uncompacted stone to create a 2-foot (0.6 m) thick compacted lift. The mandrel was raised 3 feet (0.9 m) and lowered 3 feet (0.9 m) to drive the stone into the underlying soil. The mandrel was then removed and a telltale assembly was placed into the cavity, on top of the initial compacted lift.

The mandrel was lowered back into the cavity and crushed stone aggregate was poured into the cavity until it reached the ground surface. The mandrel was raised 3 feet (0.9 m), allowing the aggregate to pass through the compaction head (via the flow-through passage), and then driven down into the aggregate 1.5 feet (0.5 m), causing the diametric restrictor elements to bind up and both compact the aggregate and to drive the aggregate laterally into the surrounding soil. The mandrel was then subsequently raised 3 feet (0.9 m) and lowered 1.5 feet (0.5 m) until reaching the ground surface. The level of stone was maintained above the compaction chamber throughout construction of the pier.

The modulus test results are shown in plot 1100 of FIG. 11. The test was conducted using a test set up and sequence used for a "quick pile load test" described in ASTM D1493. The test results show a plot of applied top of pier stress on the x-axis and top of pier deflection on the y-axis. The results indicate that the constructed piers confirmed the design and were sufficient to support the structure.

Several hundred piers were installed at this site with the technique described above to depths of up to 40 feet (12.2 m). The advantage of being able to leave the mandrel in the cavity as aggregate was added allowed for an installation time that is faster than is typically observed for traditional replacement methods. Further, the present invention was advantageous over the displacement method described in U.S. Pat. No. 7,226,246 because it allowed for higher capacities to develop in the upper cohesive soils relative to displacement methods.

Example III

In yet another example of an embodiment of the subject matter disclosed herein, a method of compacting aggregate in soil with a mandrel having a 15-inch (38.1 cm) exterior diameter and flow-through compaction chamber similar to FIGS. 12A-13B was demonstrated in full scale tests.

The mandrel was driven into the granular fill soil to a depth of approximately 10 feet (3.0 m). During the initial drive of the mandrel, it was observed that the exterior diametric expansion chains "bunched" up and outwards to form a widened compaction area such as that pictured in FIG. 13B. The diameter of cavity created by the vertical displacement of the mandrel and widened compaction area was measured to be approximately 20 inches (50.8 cm). With the mandrel at the bottom of the cavity, clean aggregate was poured into the cavity until it reached the ground surface. The mandrel was raised 3 feet (0.9 m) to allowing the aggregate to pass through the compaction chamber (via the flow through passage) and through the annular space between the outside diameter of the mandrel in the raised position and the enlarged cavity created by the mandrel during the initial drive. The mandrel was then driven 2 feet (0.6 m) causing the diametric expansion/restrictor elements to bind up and compact the aggregate in the widened area below the mandrel. The 3 ft/2 ft-up and down stroking pattern was continued until reaching the ground surface. The level of clean aggregate was maintained above the compaction chamber throughout construction of the pier.

The advantage of the increased compaction area created by the exterior diametric expansion elements (chains) allowed for more efficient aggregate flow by creating an enlarged cavity where the material could flow around the exterior diameter of the mandrel while being raised. This technique also increases the ability to use finer aggregates for backfill material in the cases where not having enough flow through area was a limiting factor.

Example IV

In still yet another example of an embodiment of the subject matter disclosed herein, a method of compacting aggregate in soil with a mandrel having a 12-inch (30.5 cm) diameter flow-through compaction chamber with exterior air injection tubes to increase aggregate flow similar to FIGS. 17A and 17B was demonstrated in full scale tests.

Several test piers were installed with a Liebherr 125 base machine equipped with an air compressor with a rated air volume flow rate of 185 cubic feet per minute. An air hose ran from the air compressor and connected to an air fitting mounted at the top of the mandrel. The air fitting ran into a splitter that tied together two steel 1 inch (2.5 cm) nominal diameter air injection tubes that ran down the outside of the opposing flanges on the I-beam drive shaft. At approximately 3 feet above the compaction chamber, the air tubes split again a second time into two 0.75 inch (1.9 cm) nominal diameter tubes that ran down the outer edges of the drive shaft flanges making a total of four air injection tubes above the compaction chamber. Along each of the four air injection tubes there were three 0.125 inch (3.18 mm) diameter injection ports spaced 1-ft center-to-center for a total of twelve injection ports. The injection ports were oriented parallel with the flange to direct the air pressure outwards to cut into the surrounding soil.

The test piers were constructed by driving the mandrel supplied with positive air pressure into the loose clean sand profile to a depth of approximately 20 feet (6.1 m). Clean aggregate backfill was added to the cavity until it reached the ground surface. The mandrel was raised 4 feet (1.2 m) allowing the aggregate backfill plus any caving sand from the surrounding soil (induced by the outward air pressure) to pass through the compaction chamber (via the flow through passage). The mandrel was then driven 3 feet (0.9 m) causing the diametric restrictor elements to bind up and compact the aggregate below the mandrel. The 4 ft/3 ft-up and down stroking pattern was continued until reaching the ground surface. The level of clean aggregate was maintained above the compaction chamber throughout construction of the pier. The air compressor was turned on and supplying the mandrel with positive air pressure during the entire build process.

In this example, cone penetration tests were performed measure the soil density through the centers of two test piers, where one test pier was constructed with a 4 ft/3 ft up/down stroke pattern and the air injection technique described above and the other was constructed with a 4 ft/3 ft up/down stroke pattern without the use of air. Cone penetration tests were performed by vertically advancing a 1.25 inch (3.2 cm) diameter steel rod affixed with a slightly larger 1.45 inch (3.7 cm) diameter cone tip through the center of the aggregate pier at a rate of approximately 2 inches per second while simultaneously measuring the penetration resistance with depth using an external load cell. The penetration resistance was measured by an external load cell with a sampling rate of 2 samples per second, or equivalently, 1 sample per inch of penetration depth.

FIG. 18 shows a plot of the cone penetration resistance measured in tons per square foot (tsf) versus depth below the ground surface in feet for both the pier constructed using air injection and the pier constructed without using air injection. FIG. 18 shows that the cone penetration resistance for the pier constructed using the air injection technique was greater than that of the pier constructed without air injection by approximately 25-50 tsf in the upper 10 feet and 50-75 tsf from 10 to 20 feet. The increase in cone penetration resistance indicates a higher stiffness pier that is associated with a larger aggregate dosage during installation. The advantage of injecting air pressure during construction resulted in better aggregate flow that ultimately increased the constructed pier stiffness for the same compactive effort.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. An apparatus for densifying and compacting granular materials comprising:

a drive shaft having a first diameter and a compaction end; and a set of one or more diametric expansion elements attached to an exterior and at the bottom of the compaction end of the drive shaft, wherein the one or more diametric expansion elements, in their expanded state, form compaction surfaces having a second diameter greater than the first diameter of the drive shaft.

2. The apparatus of claim 1 wherein the exterior diametric expansion elements are one of connected or not connected to one another.

3. The apparatus of claim 2 wherein the exterior diametric expansion elements are connected to one another through a circumferential ring.

4. The apparatus of claim 1 wherein the drive shaft is a feed tube having an internal flow passage.

5. The apparatus of claim 4 wherein the drive shaft comprises a hollow tube.

6. The apparatus of claim 1 wherein the drive shaft is a closed-end drive shaft.

7. The apparatus of claim 6 wherein the drive shaft comprises substantially a solid cylindrical shaft configuration.

8. The apparatus of claim 1 wherein the drive shaft has an upper portion with a first wall thickness and a lower portion with a second wall thickness that is less than the first wall thickness, thereby forming a notch in the drive shaft wall, and further wherein the one or more diametric expansion elements are attached to the notch.

9. The apparatus of claim 1 wherein the apparatus is configured to be inserted in a pre-drilled cavity.

10. A method of densifying and compacting granular materials, comprising:

providing a compaction apparatus comprising a drive shaft having a first diameter and a compaction end, and a set of one or more diametric expansion elements attached to an exterior and at the bottom of the compaction end of the drive shaft, wherein the one or more diametric expansion elements, in their expanded state, form compaction surfaces having a second diameter greater than the first diameter of the drive shaft;

driving the compaction apparatus into free-field soils to a specified depth;

lifting the compaction apparatus a specified distance such that the exterior diametric expansion elements move downward relative to the compaction apparatus to hang from connections to the compaction apparatus;

re-driving the apparatus downwardly into the free-field soils causing the exterior diametric expansion elements to bunch-up forming compaction surfaces; and repeating the driving and lifting of the compaction apparatus.

* * * * *